US006176565B1

(12) United States Patent
Yanai et al.

(10) Patent No.: US 6,176,565 B1
(45) **Date of Patent: *Jan. 23, 2001**

(54) CLEANING MEMBER FOR INK JET HEAD AND INK JET APPARATUS PROVIDED WITH SAID CLEANING MEMBER

(75) Inventors: Noriyuki Yanai; Masahiro Watabe; Hiroshi Tajika, all of Yokohama; Atsushi Arai, Kawasaki; Haruo Uchida, Yokohama; Kiyoshi Kuramochi, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/631,885

(22) Filed: Apr. 16, 1996

Related U.S. Application Data

(63) Continuation of application No. 08/050,451, filed on Oct. 4, 1993.

(30) Foreign Application Priority Data

Sep. 11, 1992 (WO) ..... PCT/JP92/01163

(51) Int. Cl.[7] ..... B41J 2/165
(52) U.S. Cl. ..... 347/33
(58) Field of Search ..... 347/33; 15/250.001, 15/256.5

(56) References Cited

U.S. PATENT DOCUMENTS 3,879,312 * 4/1975 Udding et al. ..... 260/2
5,126,765 * 6/1992 Nakamura ..... 347/33
5,246,977 * 9/1993 Mussini ..... 521/159

* cited by examiner

*Primary Examiner*—John Barlow
*Assistant Examiner*—Michael Brooke
(74) *Attorney, Agent, or Firm*—Fitzpatrick, Cella, Harper & Scinto

(57) ABSTRACT

A cleaning member comprising an ether series polyurethane rubber elastic body, the curing agent component of said ether series polyurethane rubber elastic body essentially consisting of a bifunctional component, or in addition, said ether series polyurethane rubber elastic body further containing a water repellency-adding material having an active group capable of chemically bonding to said polyurethane rubber.

16 Claims, 14 Drawing Sheets

CLEANING MEMBER FOR INK JET HEAD AND INK JET APPARATUS PROVIDED WITH SAID CLEANING MEMBER

This application is a continuation of application Ser. No. 08/050,451 filed Oct. 4, 1993.

FIELD OF THE INVENTION

The present invention relates to an improved cleaning member for removing foreign matters deposited at the discharging outlet face of an ink jet head for performing recording by discharging ink and to an ink jet apparatus provided with said cleaning member. The cleaning member is constituted by a material comprising a polyurethane prepolymer, a bifunctional curing agent, and a water repellancy-adding material. The cleaning member is surpassing known cleaning members especially in cleaning durability.

BACKGROUND OF THE INVENTION

According to an ink jet system described in U.S. Pat. No. 4,723,129 or U.S. Pat. No. 4,740,796, recording with a high density and a high definition and of a high quality can be conducted at a high speed. According to this ink jet system, color recording can be attained. The recording head in this ink jet system can be prepared utilizing the techniques in the field of semiconductor. The apparatus can be, therefore, relatively easily miniaturized.

In such an ink jet system, an ink jet head provided with a plurality of ink discharging outlets of an extremely minute size is used. Upon conducting recording using such ink jet head, ink is discharged through the ink discharging outlets upon the application of a recording signal to spatter and deposit on a record medium, thereby achieving the recording.

The conventional ink jet head is either of the so-called continuous type in which ink is continuously discharged such that the ink is selectively deposited on a record medium or of the so-called on-demand type in which only droplets of ink necessary for recording are intermittently discharged to a record medium.

As for the on-demand type ink jet head, there are typically known a full-line type ink jet head in which a plurality of ink discharging outlets are arranged to correspond to the width of a record medium, and a serial scanning type ink jet head in which recording is conducted by moving the head in ralation to a record medium.

Incidentally, as for an ink jet apparatus in which such an ink jet head as above described, there are still such shortcomings to be solved as will be described in the following. That is, in the case of conducting recording by using an ink jet head provided with a plurality of discharging outlets of a minute size through which ink is discharged in fine-grained form, dirts or dusts present in the recording apparatus, paper powder resulted from a record medium, or droplets of ink are likely to deposit on a discharging outlet face 1*a* provided with discharging outlets 1*b* or at positions in the vicinity of the discharging outlets as shown in FIGS. 7(*a*) and 7(*b*). These deposits often hinder the direction of flight of droplets discharged from the discharging outlets, or they are sometimes dried and solidified to plug up some of the discharging outlets such that ink cannot be not discharged through those discharging outlets.

In order to eliminate these problems, there has been proposed a so-called blade cleaning method wherein the discharging outlet face deposited with such foreign matters is brushed by means of a blade made of an elastic material such as polyurethane rubber, polyester-urethane rubber, hydrogenated nitrile rubber, or silicone rubber to remove the foreign matters from the discharging outlet face.

Now, there is an increasing demand not only for a mono-color ink jet recording apparatus but also for a multicolor ink jet recording apparatus provided with four individual ink jet heads respectively capable of discharging ink of a different color of yellow, magenta, cyanogen, or black. In the case of the recording in which color tone is varied using these four inks of a different color, it is necessary to discharge a plurality of different inks as for a dot and because of this, rather strict discharging accuracy is required than that in the case of conducting recording using a momo-color ink jet recording apparatus. Therefore, it is necessary for the discharging outlet face of each of the recording heads, which discharge individual ink of a different color, to be maintained in a cleaned state so that stable ink discharging is always provided. For this purpose, the cleaning reliability by means of the blade cleaning is necessary to be always secured.

As for the cleaning blade used in such full-color recording apparatus, there are known a configuration in which an independent cleaning blade is installed in each of the recording heads and another configuration in which a common cleaning blade is installed in the apparatus so that each of the recording heads can be cleaned by the common cleaning blade. In the viewpoint of reducing the area occupied by the cleaning blade in the recording apparatus as much as possible in order to miniaturize the size of the recording apparatus, the manner of cleaning each of the four recording heads by a common cleaning blade is the most desirable. However, in this cleaning manner of cleaning the individual recording heads continuously discharging different inks by a common cleaning blade, there is a tendency that those different inks are mixed on the cleaning blade to result in causing the formation of an image defective in color tone.

In order to eliminate this problem, there has been proposed a manner in which the cleaning is conducted successively from the recording head of discharging ink of relatively light color to the recording head of discharging ink of dark color to prevent occurrence of ink admixture at the recording head of discharging light color ink.

Another manner has been proposed in which an ink absorbent is disposed between each adjacent color ink jet heads, after one of the heads has been cleaned by a cleaning blade, ink deposited on the cleaning blade is removed by the ink absorbent, wherein the next head can be cleaned by the cleaning blade without suffering from any negative influence from the previously cleaned head.

In the following, description will be made of the latter cleaning manner with reference to FIG. 1. As apparent in FIG. 1, a main scanning carriage 2 provided with ink jet heads 2 is designed to travel on a main scanning rail 3. In the non-recording zone separate from the recording zone in the apparatus, a cleaning blade 4 is arranged such that it contacts with a discharging outlet face 1*a* of the ink jet head 1. Reference numeral 5 indicates a holder which serves to fix the cleaning blade 4. By moving the main scanning carriage 2 in the direction expressed by mark A, the discharging outlet face 1*a* is rubbed by the cleaning blade 4 arranged in the non-recording zone, whereby deposits X such as ink droplets, paper powder, dusts, and the like which are deposited on the discharging outlet face 1*a* are removed by the action of an edge of the cleaning blade 4. The ink deposited on the cleaning blade 4 is removed by an ink absorbent 6 which is disposed between each adjacent ink jet heads. Thus, the cleaning blade 4 in cleaned state comes to the result of serving to clean the next ink jet head. According to this manner, all the individual recording heads of discharging ink of a different color can desirably be cleaned by the cleaning blade in cleaned state without causing admixture among the different inks. In this cleaning manner, the cleaning blade is rubbed with the discharging outlet face as many times as the number of the ink jet heads in one cleaning operation cycle and therefore, the frequency of the cleaning blade to be rubbed is greater than that in other cleaning manner.

Independently, in recent years, research and development have been made not only of high speed recording but also of the manner which enables high-volume recording by a single recording apparatus comprising an ink jet recording head of the head-exchangeable type in such viewpoints as will be described in the following.

For instance, in the case of the high speed ink jet recording apparatus, since the amount of ink to be discharged in terms of unit hour unavoidable becomes great, ink becomes more liable to deposit on the discharging outlet face of the recording head. In order to avoid occurrence of this problem, it is necessary to shorten the timing of the cleaning of the recording head and to frequently conduct the cleaning.

In the case of the ink jet recording apparatus which enables high-volume recording, when the apparatus is repeatedly used over a long period of time while exchanging the recording head many times, the frequency of using the cleaning blade in order to clean those recording heads unavoidably becomes extremely great.

Thus, it is understood that the cleaning operation cycle in such ink jet recording apparatus as above described is repeated great many times. Particularly, in the case of the foregoing color recording, as described in the above with reference to FIG. 1, since the cleaning blade is rubbed not only with the discharging outlet face of the recording head but also with the ink absorbent, the frequency of the cleaning blade to be rubbed becomes significantly great. In view of this, it is desired for the cleaning blade to be further improved in terms of durability.

Now, there are known various cleaning blades to be used in the blade cleaning method which are constituted by an elastic material such as silicone rubber, hydrogenated nitrile rubber, polyester-urethane rubber, or polyether-urethane rubber.

However, any of these materials has problems such as will be under described.

That is, silicone rubber is relatively poor in abrasion resistance. Because of this, when rubbed continuously with the ink jet head and the ink absorbent, the silicone rubber member is gradually worn and as a result, the cleaning which is conducted utilizing an edge portion of the cleaning blade becomes insufficient. Particularly problems are occurred in this case in that the worn cleaning blade permits ink to pass through its portion in contact with the discharging outlet face of the head, wherein foreign matters deposited cannot be sufficiently removed. This leads to causing problems such that the residual ink or foreign matters left without having been removed prevent ink from being stably discharged through the discharging outlets, wherein stable flight orbit of ink particle cannot be attained, resulting in providing defective recorded images accompanied by blurred portions or lines or that the discharging outlets of the ink jet head are clogged with powdery materials generated when the cleaning blade is worn, resulting in providing defective recorded images accompanied by lines. Other than these problems, there is also a problem in that inorganic fillers such as silica contained in the silicone rubber sometime damage portions near the discharging outlets of the ink jet head upon conducting the cleaning by the cleaning blade, resulting in preventing ink from being stably discharged while providing flight orbit of ink particle as desired, wherein defective recorded images are provided. Further, oily components contained in the silicone rubber are liable to modify the composition of ink, wherein the ink is hardly bubbled, resulting in providing defective recorded images accompanied by undischarged lines caused due to insufficient ink bubbling.

In the case where the silicone rubber cleaning blade is employed for cleaning an ink jet system in which droplets of ink are discharged through a discharging element utilizing thermal energy, the foregoing oily components of the silicone rubber are liable to enter into the discharging outlets, wherein the heat generating body, which serves to generate thermal energy, is liable to be sintered because of those oily components, resulting in preventing ink from being discharged, and as a result, there cannot be obtained desirable recorded images.

The hydrogenated nitrile rubber is relatively poor in abrasion resistance as well as the silicone rubber. In the case where the cleaning blade constituted by the hydrogenated nitrile rubber is employed for cleaning the foregoing color ink jet recording apparatus provided with the ink absorbents, significant wear is caused at the cleaning blade when continuously used over a long period of time as a result of having been repeatedly rubbed with the ink jet heads and the ink absorbents, wherein the cleaning cannot be sufficiently conducted, resulting in leaving ink deposits or other deposited foreign matters without being removed and a result, desirable ink discharging accuracy cannot be attained, resulting in providing defective recorded images. Because of this, the cleaning blade constituted by the hydrogenated nitrile rubber is problematic especially in terms of durability. The hydrogenated nitrile rubber usually contains oily components for the purpose of improving its hardness. These oily components are liable to enter into the recording heads, wherein there are problems such that their heat generating body is liable to be sintered because of the oily components or the composition of ink is liable to be modified as well as in the case of using the silicone rubber.

Now, urethane rubbers such as polyester-urethane rubber and polyether-urethane rubber are presently often used as a constituent material of the cleaning blade since they are not necessary to be incorporated with either an inorganic filler or an oily component, and they are free of the foregoing problem of damaging the discharging outlet face due to the filler and of the foregoing problems due to the oily components, and are relatively satisfactory in therms of durability when used as the cleaning blade.

However, in the case where the cleaning blade constituted by such urethane rubber is employed for cleaning the full-color ink jet apparatus shown in FIG. 1, there is a problem in that when the cleaning blade continuously and repeatedly rubbed with the four ink jet heads and ink absorbents, such partially worn portions as shown in FIG. 4(*b*) are liable to occur at the edge portion of the cleaning blade to provide an unevenly worn state (a face state provided with irregularities). With the cleaning blade having such unevenly worn state at the edge portion, satisfactory cleaning cannot be attained in the cleaning operation, wherein ink-escape 10B is caused through such partially worn portion as shown in FIG. 7(*d*), resulting in leaving ink deposits in the vicinity of the discharging outlets without being removed. Such residual ink deposits in the vicinity of the discharging outlets is apt to cause so-called gap defect wherein flight orbit of ink discharged from the discharging outlets is deranged. Further, in the case where the unevenly worn state is enlarged and the amount of such ink deposits left without being removed is increased, ink discharged is sometimes taken into the ink deposits, resulting in causing a situation such that ink is not discharged, that is, no image is recorded. In addition, in the case where an unevenly worn state is occurred at the edge portion of the cleaning blade, the urging pressure by the cleaning blade is centralized at other edge portion thereof with no broken portion and as a result, the area to be contacted with ink (that is, meniscus portion) is increased, resulting in promoting the situation of pulling out ink from the discharging outlets (see, FIG. 5(*b*)).

Particularly, as for polyester-urethane rubber, it is liable to cause hydrolysis because of its structure and thus, it is liable to deteriorate due to moisture of the air. In the case where the cleaning blade constituted by this rubber is used in an ink jet recording apparatus in which aqueous ink is used, there is a fear that the rubber is deteriorated due to moisture of the ink to lose its elasticity, resulting in not providing a desired urging force to the edge portion of the cleaning blade upon conducting the cleaning operation. Thus, the cleaning blade is poor in durability upon repeated use over a long period of time.

The foregoing urethane rubbers have at least a polar group in their structure. Because of this, as for the cleaning blade constituted by such urethane rubber, the constituent urethane rubber is liable to absorb aqueous ink used in an ink jet recording head. Particularly, the cleaning blade is continuously contacted with such ink over a long period of time, the constituent urethane rubber becomes dwelled because of the ink. This situation results in causing various problems. That is, the cleaning blade pulls out ink in the discharging outlets by virtue of the affinity upon conducting the cleaning (see, FIG. 5(*b*)), wherein ink remains in the vicinity of the discharging outlets without being removed. Such residual ink affects the direction of ink discharged to deteriorate the discharging accuracy, wherein the foregoing gap defect is caused. Other than this, the residual ink remained on the cleaning blade often becomes such that it is hardly removed after the cleaning and thus, it is remained as a blade foul which leads to reducing the cleaning efficiency in successive cleaning operation. Especially, in the case where the cleaning blade is used in an ink jet recording apparatus in which a plurality of inks having a different color are used, off-shade is often occurred due to such deterioration in discharging accuracy. In addition to this, at the stage where the residual ink taken up by the cleaning blade is removed by the ink absorbent, when the cleaning blade has a strong affinity with the ink, sufficient removal of the ink cannot be attained, resulting in causing undesirable color mixture.

The above problems relating to the cleaning blades are not so serious, for example, in the case of a personal type ink jet recording apparatus in which the number of recording sheets used per recording is not large and which is not frequently used. Particularly, as for the personal type ink jet recording apparatus, it is usually of a system in which recording is conducted with one ink, and the number of recording sheets used per recording is small and in addition, it is usually not used such that the cleaning is necessary to be frequently conducted.

On the other hand, in the foregoing full-color type recording apparatus, high speed recording apparatus or long-time usable recording apparatus of the recording head exchangeable type, the use frequency of the cleaning blade is higher than that in the case of using of the personal type recording apparatus in view of restoring or improving the quality of an image recorded, and a high reliability and durability are required for the cleaning blade. Particularly in the case of the full-color recording apparatus, as above described, since the cleaning blade is continuously rubbed with a plurality of recording heads and a plurality of ink absorbents in one cleaning operation, and the frequency of the cleaning blade to be rubbed with the recording heads and the ink absorbents is extremely increased, and therefore, the cleaning blade is required to be satisfactory in terms of reliability and durability.

Under such circumstance as above described, the present invention is intended to provide a material suitably usable as the cleaning blade for the recording head which is installed in a recording apparatus for which provision of a high quality recorded image is required and which is continuously used over a long period of time.

The present inventors made various studies in order to eliminate the foregoing problems in the prior art. The studies by the present inventors were conducted while focusing on the polyurethane rubber materials above illustrated as the constituent material of the cleaning blade, in the viewpoints that the polyurethane rubber materials are not necessary to be incorporated with inorganic fillers or/and oily components which are apt to give negative influences not only to ink but also to the recording head as above described, and they are relatively good in abrasion resistance. The present inventors conducted various experimental studies with respect to these polyurethane materials while selecting their constituent material, and changing and adjusting an additive to be incorporated. As a result, there were obtained such knowledges as will be described in the following.

Firstly, description will be made of the knowledges obtained with respect to improvement in abrasion resistance of the cleaning blade. In general, as the curing agent for polyurethane rubber, there are used a bifunctional component as a chain-lengthening agent and a polyfunctional (which means trifunctional or more) component as a cross-linking agent are used. The polyfunctional component serves to prevent occurrence of slide, deviation or the like among adjacent molecules when the rubber is applied with a deformation stress. This makes it possible to form a rubber which is free of permanent deformation and which is small in pressure permanent distortion. However, the polyfunctional component constrains movements of the adjacent molecules not only to prevent the polar groups in the urethane rubber from being mutually reacted (agglomeration) but also to prevent the backbone chain molecules in the urethane rubber from being mutually reacted (crystallization). This results in reducing the strength (tear propagation strength and tensile yield strength) of the rubber. Especially, in the case of polyether-urethane rubber, a distinct difference is provided with respect to tear propagation strength and tensile yield strength depending upon whether the polyfunctional component is present or not present.

The results obtained as a result of the studies by the present inventors showed that the state of being worn differs depending upon whether a polyfunctional component is present or not present. Particularly, the present inventors studied of abrasion by providing a cleaning blade comprised of a polyether-urethane rubber with a composition containing a polyfunctional component, setting the cleaning blade to an ink jet recording apparatus of the constitution shown in FIG. 8, and operating the apparatus. As a result, such partially worn portions (chippings) as shown FIG. 4(*b*) were occurred at the cleaning blade to have been rubbed with the discharging outlet face of the recording head, those worn portions of the cleaning blade being in unevenly worn state. The same procedures have been repeated, except that a cleaning blade comprised of a polyether-urethane rubber containing only a bifunctional component was used. The results showed that the cleaning blade has such a uniformly worn face as shown in FIG. 4(*a*) with no accompaniment of such partially worn portions.

This difference in terms of worn state is serious as for the cleaning blade for the ink jet recording head. That is, in the case where an unevenly worn state due to such chippings as shown in FIG. 4(*b*) is occurred at the cleaning blade, upon conducting the cleaning operation, ink-escape 10B is caused through such partially worn portions as shown in FIG. 7(*d*) to remain ink in the vicinity of the discharging outlets, wherein such residual ink leads to causing defects in the recording such as gap defect or non-discharging wherein no recorded image is provided. In addition, in the case where such partially worn portions are occurred at the edge portion of the cleaning blade, the urging pressure by the cleaning blade is centralized at other edge portion thereof with no accompaniment of such partially worn portion, resulting in promoting the situation of pulling out ink from the discharging outlets (see, FIG. 5(*d*)).

On the other hand, in the case of using the cleaning blade comprised of the bifunctional component-containing polyether-urethane rubber, the cleaning blade is rubbed to provide a uniformly worn face at the edge portion with no accompaniment of such partially worn portions. Therefore, no ink-escape is occurred, and a uniform urging force is provided by the cleaning blade, wherein the amount of ink to be pulled out from the discharging outlets can be minimized, and the cleaning can be conducted in good state as shown in FIG. 7(*c*).

Herein, description will be made of the situation wherein ink is pulled out from the discharging outlets with reference to FIGS. 2 and 3.

A cleaning blade 7 which serves to rub the ink discharging outlet face 1*a* of the recording head is pressed at a relevant pressure. Therefore, if the cleaning blade 4 is accompanied by such broken portions as above described at the edge portion thereof, a stress is centralized at other edge portion thereof with no partially worn portion. In this case, there is a tendency that the edge portion with no partially worn portion of the cleaning blade 4 enters into the inside of an ink discharging outlet 1*b* in such a state as shown in FIG. 2. Incidentally, at the ink discharging outlet 1*b*, there is formed a meniscus M due to a given surface tension possessed by the ink present in the ink pathway and a negative pressure applied to the ink.

When the edge portion of the cleaning blade 4 at which the stress is centralized enters into the inside of the ink discharging outlet as above described, the edge portion occasionally contacts with the meniscus portion M according to the entrance extent of the edge portion. If the cleaning blade is moved under the state thus contacted, the ink in contact with the cleaning blade is eventually pulled out from the discharging outlet (see, FIG. 5(*b*)). Herein, the residual ink present between the cleaning blade 4 and the discharging outlet 1*a* of the recording head indicates the ink taken up by the cleaning operation.

On the other hand, in the case of the cleaning blade comprised of the polyether-urethane rubber containing a bifunctional component only as the curing agent, since no broken portion is occurred at the edge portion thereof and no stress centralization is occurred, such a phenomenon that the edge portion of the cleaning blade enters into the inside of the discharging outlet 1*b* of the recording head is hardly occurred. If the edge portion of the cleaning blade should enter into the inside of the discharging outlet of the recording head, the entrance extent is extremely small, wherein there is a slight occasion for the edge portion to be contacted with the meniscus M. In addition, in the case of using the cleaning blade comprised of the polyether-urethane rubber containing a bifunctional component only as the curing agent, a uniformly worn state is provided at the edge portion thereof. Therefore, as shown in FIG. 3, if the cleaning blade should be worn, the edge portion of the cleaning blade hardly enters into the inside of the discharging outlet 1*b* of the recording head. If the abraded edge portion of the cleaning blade should enter into the inside of the discharging outlet of the recording head, the entrance extent is extremely small, wherein there is a slight occasion for the edge portion to be contacted with the meniscus M. This means that ink is hardly pulled out from the discharging outlet upon conducting the cleaning operation.

Other than the above knowledges, the present inventors obtained the following knowledges in view of necessity of improving the water repellency of the cleaning blade.

The phenomenon shown in FIG. 2 in which during the cleaning operation, the cleaning blade 4 enters into the inside of the discharging outlet 1*b* of the recording head and it contacts with the meniscus M of ink formed in the discharging outlet to pull out the ink deposited on the cleaning blade from the discharging outlet along with the movement of the cleaning blade (wherein the amount of the ink to be pulled out is different depending upon the self surface tension of the ink and the water repellency of the cleaning blade) differs also depending upon the water repellency of the cleaning blade.

Shown in FIG. 6 is of the interrelation between the angle at which the cleaning blade material and the area of the ink deposited. As apparent from FIG. 6, it is understood that there is a tendency that the smaller the angle θ at which cleaning blade material is contacted, the greater the area of the ink deposited, and the greater the angle θ at which cleaning blade material is contacted, the smaller the area of the ink deposited. Particularly, the angle at which the cleaning blade 4 is contacted with the ink at the position where the cleaning blade is in contact with the discharging outlet is related to the amount of the ink to be pulled out, wherein the lower the water repellency of the cleaning blade, the smaller the foregoing ink contact angle, resulting in increasing the amount of the ink deposited on the cleaning blade, whereby the amount of the ink to be pulled out is increased. Therefore, at the conditions under which ink is liable to deposit on the constituent material of the cleaning blade, the ink once deposited on the cleaning blade at a given position thereof comes to a result that it is taken out from the discharging outlet without being removed along the movement of the cleaning blade during the cleaning operation (see, FIG. 5(*b*)).

The present inventors obtained a finding that the angle at which the cleaning blade is contacted with the ink can be enlarged by imparting an relevant water repellency to the cleaning blade and by this, the amount of the ink deposited on the cleaning blade can be diminished, whereby the amount of the ink to be pulled out from the discharging outlet can be reduced, and the cleaning can be desirably conducted.

SUMMARY OF THE INVENTION

The present invention has been accomplished based on the foregoing results obtained as a result of the studies conducted by the present inventors, and it makes an object to provide an improved cleaning blade for ink jet head which is formed of a material comprising a polyuretane polymer, a bifunctional curing agent and a water repellency-adding material, said cleaning blade being free of occurrence of uneven wear due to chipping and the like even upon continuously conducting recording while conducting cleaning with the use of said cleaning blade wherein a desirable cleaning state can be constantly maintained even upon repeated use of said cleaning blade over a long period of time while preventing ink from being pulled out from the discharging outlet of the ink jet head.

Another object of the present invention is to provide a cleaning blade for ink jet head which comprises an elastic material excelling in abrasion resistance which is added with a desirable water repellency, said cleaning blade being excellent in ink break and being capable of effectively preventing ink from being pulled out from the discharging outlet, and said cleaning blade being capable of being desirably used in an ink jet head capable of providing an excellent recorded image.

A further object of the present invention is to provide an ink jet recording apparatus in which the above cleaning blade is used.

A further object of the present invention is to provide an cleaning member capable of removing foreign matters deposited on the ink discharging outlet face of an ink jet recording head for conducting recording on a record medium by discharging ink, said cleaning member being characterized by comprising an ether series polyurethane rubber elastic body containing a curing component essentially consisting of a bifunctional component.

A further object of the present invention is to provide an cleaning member capable of removing foreign matters deposited on the ink discharging outlet face of an ink jet recording head for conducting recording on a record medium by discharging ink, said cleaning member being characterized by comprising a polyurethane rubber elastic body containing a curing component essentially consisting of a bifunctional component and a water repellency-adding material having an active group reactive with said polyurethane rubber.

A further object of the present invention is to provide an ink jet apparatus comprising a support member capable of supporting an ink jet head of conducting recording on a record medium by discharging aqueous ink, characterized in that said ink jet apparatus comprises means for scanning said support member between a recording zone in which said record medium is transported and a non-recording zone outside said recording zone, said non-recording zone being provided with a cleaning blade capable of cleaning the discharging outlet face of said head, and said cleaning blade comprising an ether series polyurethane rubber elastic body containing a curing component essentially consisting of a bifunctional component.

A further object of the present invention is to provide an ink jet apparatus comprising a support member capable of supporting an ink jet head of conducting recording on a, record medium by discharging aqueous ink, characterized in that said ink jet apparatus comprises means for scanning said support member between a recording zone in which said record medium is transported and a non-recording zone outside said recording zone, said non-recording zone being provided with a cleaning blade capable of cleaning the discharging outlet face of said head, and said cleaning blade a polyurethane rubber elastic body containing a curing component essentially consisting of a bifunctional component and a water repellency-adding material having an active group reactive with said polyurethane rubber.

The urethane material which can be desirably used as the main constituent material of the cleaning blade according to the present invention can include urethane materials of ethyleneadipate series, butyleneadipate series, lactone series, polyester series, polycarbonate series, and polyether series. Among these, polyether urethanes are the most desirable particularly in view of hydrolytic property.

Examples of such polyether urethane are those polyether urethanes obtained by reacting polyoxytetramethylene glycol (hereinafter referred to as PTMEG) represented by the general formula $HO(CH_2CH_2CH_2CH_2O)_nH$ with polyisocyanate. Specifically, these can be illustrated commercially available VIBRATHANEs B625, B635, B670, B821, and B836 (trademark names, produced by Uniroyal Chemical Company); and commercially available ADIPIRENEs M400, M415, M467, M483, LW520, and LW570 (trademark names, produced by Du Pont Company). Other these, there can be illustrated other polyether urethanes obtained by reacting polyoxypropylene glycol represented by the general formula $HO(CH_2CH_2CH_2O)_nH$ with polyisocyanate. A specific example is a commercially available VIBRATHANE 843 (trademark name, produced by Uniroyal Chemical Company). It should be understood that these are not limitative.

The above mentioned polyisocyanate is not limitative. Any of other isocyanates which are commonly used in the production of polyurethane can be used. Specific examples of such isocyanate are diphenylmethane diisocyanate, tolylene diisocyanate, hexamethylene diisocyanate, naphthalene diisocyanate, and hydrogenated diphenylmethane diisocyanate.

The curing agent which serves to make the polyurethane material to provide the foregoing cleaning blade capable of being worn in such a uniformly worn state as above described is required to comprise a bifunctinal curing agent. Specific examples of the bifunctional curing agent are 1,4-butanediol, 1,6-hexanediol, ethylene glycol, propylene glycol, polyethylene glycol, hydroquinone ethylol ether, bisphenol A, methylenebisorthodichloroaniline, triethylene glycol p-aminobenzoate, commercially available curing agents VIBRACUREs A120 and A931 (trademark names, produced by Uniroyal Company), and MOCA, and mixtures of two or more of these. Of these curing agents, straight-chain diols are the most desirable in the viewpoints that they are hardly hyrolyzed and are not inhibitive for crystallinity. In the present invention, the use of the bifunctional curing agent does not exclude incorporation of other polyfunctional curing agents as long as their content is in a slight amount as an impurity.

In the viewpoint of improving the initial cleaning property of the cleaning blade, it is possible to use, in addition to the bifunctional curing agent, other polyfunctional curing agent within a prescribed amount (40% or less of the total amount of the curing agents), provided a water repellency-adding material, which will be under described, is together used. Specific examples of such polyfunctional curing agent are common urethane-curing agents such as trimethylolpropane, trimethylolethane, and glycerin, and commercially available curing agents VIBRACURES A125, A510, and A567, (trademarks, produced by Uniroyal Company), 3080 and 3095 (trademark names, produced by Uniroyal Company), and mixtures of two or more of these.

As the water repellency-additing material serving to improve the cleaning blade such that it does not take up ink in the present invention, those which do not bleed to reduce the water repellency of the cleaning blade even upon repeated use over a long period of time are desirably used. Desirable examples are water repellenvy-adding materials having at least an active group reactive with the foregoing polyurethane material such as hydroxyl group, amino group, epoxy group, isocyanate group, and the like in one molecule. And it is desired for these water repellency-adding materials to contain a chemical structure having low surface energy in their molecule, in the viewpoint that when the cleaning blade is required to maintain its water repellency even in the case where it is in a swelled state as a result of having absorbed ink.

Such water repellency-adding material can include modified silicone compounds and reactive fluorine-containing compounds. Commercially available examples of the reactive fluorine-containing compounds are MF 100, MF110, MF120, and MF130 (produced by Mitsubishi Material Corporation); Cm Alcohol and HFIP (produced by Central Glass Co., Ltd.); and PFA6 (produced by NEOS Company Ltd.).

Commercially available examples of the modified silicone compounds are amino-modified silicones SF8417, and BY16-828 (produced by Toray Dow Corning Silicone Co., Ltd.); epoxy-modified silicone SF8411 (produced by Toray Dow Corning Silicone Co., Ltd.); and alcohol-modified silicones BX16-005, SF8427 and SF8428 (produced by Toray Dow Corning Silicone Co., Ltd.), X-22-160AS (produced by Shinetsu Silicone Company), and DKQ8-779 (produced by Dow Corning Company). It should be understood that these are not limitative.

Now, when a water repellency-adding material which is slightly soluble in the foregoing polyurethane rubber material is used, it becomes present in particle state in the polyurethane rubber material. In the case where such water repellency-adding material is present in particle state in the polyurethane rubber material, the effect of adding a water repellency to the polyurethane rubber material is not sufficient. In order to avoid occurrence of this problem, it is necessary to add an excessive amount of such water repellency-adding material. However, in this case, the physical properties of the polyurethane rubber material are more or less deteriorated. In addition, the presence of particle components of such water repellency-adding material often becomes to be a cause of providing uneven wear at the cleaning blade during the cleaning operation, and therefore, such cleaning blade is not suitable for long time use. In view of this, it is desired for the water repellency-adding material to be present in a state of being compatible with the polyurethane rubber material.

Further, in the case of using the cleaning blade in an ink jet system in which recording is conducted by discharging ink droplets by means of a discharging element, the use of a modified silicone compound is not desirable in the viewpoint that there is a fear that foreign matters from the compound are seized at the heat generating body.

Taking account of the solubility the polyurethane rubber material and a fear of the occurrence of seizing foreign matters to the heat generating body, the foregoing reactive fluorine-containing compounds are the most desirable.

In the present invention, the ink contact angle for the cleaning blade is desired to be 80° or above. It should be understood that the ink contact angle in any of the cases which satisfy the under-described definite amounts of the respective components is within the above range.

As a most preferred embodiment of the constituent material of the cleaning blade according to the present invention, there can be mentioned materials comprising a polyurethane material as the main component, a curing agent essentially consisting of a bifunctional component and a water repellency-adding material.

The cleaning blade formed of such a specific material is markedly advantageous in that a uniformly worn state peculiar for the cleaning blade is provided because of using the bifunctional curing agent during the cleaning operation, and a desired contact angle is maintained between the cleaning blade and the ink because of using the water repellency-adding material, wherein the amount of the ink to be pulled out from the discharging outlet during the cleaning operation is markedly diminished, and the blade cleaning operation can be conducted with a constant and uniform pressure without causing any ink escape.

The amount of each of the bifunctional curing agent and the water repellency-adding material to be incorporated is desired to be made such that the sum of the morality of the active element of the bifunctional curing agent and that of the water repellency-adding material is preferably in the range of from 0.80 to 1.05, more preferably in the range of from 0.90 to 1.00, versus the morality of the isocyanate group contained in the polyurethane material as the main component of the cleaning blade.

Particularly, as for the amount of the water repellency-adding material, it is desired to be preferably in the range of from 0.1 to 20 parts by weight, more preferably in the range of from 1 to 10 parts by weight, versus 100 parts by weight of the sum of the polyurethane material and the bifunctional curing agent. In the case where the use amount of the water repellency-adding material is less than 0.1 part by weight, a sufficient water repellency is not provided, resulting in causing the foregoing ink pull-out and color admixture. In the case where the use amount of the water repellency-adding material is exceeding 20 parts by weight, the rubber physical properties are remarkably deteriorated, wherein there is a fear that marked wear is caused at the cleaning blade upon repeatedly use over a long period of time.

In a preferred embodiment of the present invention, there are included a cleaning blade member obtained by using the polyurethane material and the bifunctional curing agent and a cleaning blade member obtained by using the polyurethane material as the main starting material, the bifunctional curing agent, a polyfunctional curing agent (in a slight amount), and the water repellency-adding material. Herein, the use of the bifunctional curing agent only does not exclude such a case that a polyfunctional curing agent in an amount in terms of an impurity is contained. The amount of the bifunctional curing agent to be incorporated and that of the water repellency-adding material in each of said two cleaning blade members are adjusted to satisfy the definite range described in the foregoing most preferred embodiment.

The cleaning blade member according to the present invention can be prepared in a manner that a given amount of the polyurethane material in molten state, a given amount of the bifunctional curing agent in molten state, and if necessary, a given amount of the water repellency-adding material having been heated, are mixed while stirring to obtain a mixture, if necessary followed by degassing, the resultant mixture is introduced into a die or a centrifugal making machine, wherein the mixture is subjected to heat curing treatment at a temperature of 80 to 140° C. It is possible that the water repellency-adding material is firstly mixed with the polyurethane material to chemically react with each other and thereafter, the curing agent is added thereto. Further, it is possible that the water repellency-adding material is firstly resolved in or dispersed into the curing agent, and the resultant is subjected to chemical reaction with the polyurethane material.

In the cleaning blade member thus prepared, the water repellency-adding material is contained in the inside of the polyurethane rubber resulted, and because of this, the cleaning blade member always maintain a desirable water repellency without being reduced even when its surface is worn upon the rubbing. The hardness of the constituent rubber material of the cleaning blade member should be properly determined depending upon the cleaning property of the ink used. However, in general, it is desired to be preferably in the range of from 40° to 90°,more preferably in the range of from 50° to 90° in terms of JISA Hardness.

EXPERIMENTS

In the following, description will be made of the experiments conducted by the present inventors.

Experiment A 22.7 parts by weight of heat-molten polyethylene glycol (as the bifunctional curing agent, molecular weight: 1000) was mixed with 5.7 parts by weight of 1,4-butanediol (as the bifunctional curing agent) to obtain a mixture. To the mixture, 3.6 parts by weight of N-n-propyl-N-2,3-dihydroxypropylperfluorooctylsulfoneamide (as the fluorine-containing water repellency-adding material, trademark name: FM 110, produced by Mitsubishi Materials Corporation) was added while stirring at 90° C., to thereby obtain a homogenous solution.

The resultant solution was mixed with 100 parts by weight of polyurethane polymer (ether series PTMEG-MD 1, NOCO content : 7.7 wt. %, trademark name: VIBRATHANE B635, produced by Uniroyal Chemical Company) maintained at 80° C. while stirring to obtain a mixture wherein the molarity of each of the active element of the curing agent and that of the water repellency-adding material versus the molarity of the isocyanate group of the polyurethane polymer (hereinafter referred to as OH/NCO) was adjusted to be 1.00. The resultant mixture was subjected to degassing treatment under vacuum condition, to thereby obtain a homogenous liquid mixture.

The liquid mixture obtained was introduced into a centrifugal making machine maintained at 130° C., wherein the liquid mixture was subjected to curing treatment for an hour. The resultant was taken out from the making machine, followed by subjecting to secondary curing treatment at 130° C. for 4 hours, whereby a 0.7 mm thick transparent sheet member containing the water repellency-adding material in an amount of 3 parts by weight versus 100 parts by weight of the total amount of the polyurethane and the curing agent.

The resultant sheet was subjected to edge-cutting, followed by subjected to die cutting into a size of 10 mm×15 mm, to thereby obtain a cleaning blade sample A for test. This blade sample was served for evaluation with respect to various evaluation items which will be later described.

Experiment B

The procedures of Experiment A were repeated, except that the amount of each of the polyethylene glycol, 1,4-butanediol, and N-n-propyl-N-2,3-dihydroxypropylperfluorooctylsulfoneamide was changed to 23.6 parts by weight, 5.9 parts by weight, and 1.3 parts by weight, respectively, to thereby obtain a transparent sheet in which the amount of the water repellency-adding material was adjusted to be about 1 part by weight. The sheet was subjected to die cutting under the same condition as in Experiment A, whereby a cleaning blade sample B for test was obtained.

Experiment C

The procedures of Experiment A were repeated, except that the amount of each of the polyethylene glycol, 1,4-butanediol, and N-n-propyl-N-2,3-dihydroxypropylperfluorooctylsulfoneamide was changed to 21.6 parts by weight, 5.4 parts by weight, and 6.3 parts by weight, respectively, to thereby obtain a transparent sheet in which the amount of the water repellency-adding material was adjusted to be about 5 parts by weight. The sheet was subjected to die cutting under the same condition as in Experiment A, whereby a cleaning blade sample C for test was obtained.

Experiment D

The procedures of Experiment A were repeated, except that the amount of each of the polyethylene glycol, 1,4-butanediol, and N-n-propyl-N-2,3-dihydroxypropylperfluorooctylsulfoneamide was changed to 24.0 parts by weight, 6.0 parts by weight, and 0.2 part by weight, respectively, to thereby obtain a transparent sheet in which the amount of the water repellency-adding material was adjusted to be about 0.2 part by weight. The sheet was subjected to die cutting under the same condition as in Experiment A, whereby a cleaning blade sample D for test was obtained.

Experiment E

The procedures of Experiment A were repeated, except that the amount of each of the polyethylene glycol, 1,4-butanediol, and N-n-propyl-N-2,3-dihydroxypropylperfluorooctylsulfoneamide was changed to 18.6 parts by weight, 4.7 parts by weight, and 13.4 parts by weight, respectively, to thereby obtain a transparent sheet in which the amount of the water repellency-adding material was adjusted to be about 10 parts by weight. The sheet was subjected to die cutting under the same condition as in Experiment A, whereby a cleaning blade sample E for test was obtained.

Experiment F

The procedures of Experiment A were repeated, except that the amount of each of the polyethylene glycol, 1,4-butanediol, and N-n-propyl-N-2,3-dihydroxypropylperfluorooctylsulfoneamide was changed to 14.1 parts by weight, 3.5 parts by weight, and 23.5 parts by weight, respectively, to thereby obtain a transparent sheet in which the amount of the water repellency-adding material was adjusted to be about 20 parts by weight. The sheet was subjected to die cutting under the same condition as in Experiment A, whereby a cleaning blade sample F for test was obtained.

Experiment G

The procedures of Experiment A were repeated, except that the amount of each of the polyethylene glycol, 1,4-butanediol, and N-n-propyl-N-2,3-dihydroxypropylperfluorooctylsulfoneamide was changed to 19.3 parts by weight, 4.8 parts by weight, and 3.2 parts by weight, respectively, wherein the OH/NOC was adjusted to be 0.8, to thereby obtain a cleaning blade sample G for test.

Experiment H

The procedures of Experiment A were repeated, except that the amount of each of the polyethylene glycol, 1,4-butanediol, and N-n-propyl-N-2,3-dihydroxypropylperfluorooctylsulfoneamide was changed to 23.8 parts by weight, 6.0 parts by weight, and 3.8 parts by weight, respectively, wherein the OH/NOC was adjusted to be 1.05, to thereby obtain a cleaning blade sample H for test.

Experiment I

The procedures of Experiment A were repeated, except that the water repellency-adding material was changed to 3-(2-perfluorohexyl)ethoxy-1,2 dihyroxypropane (as the fluorine-containing water repellency-adding material, trademark name: MF100, produced by Mitsubishi Materials Corporation) of 3.6 parts by weight, to thereby obtain a cleaning blade sample I for test.

Experiment J

The procedures of Experiment A were repeated, except that the water repellency-adding material was changed to $C_9F_{17}O—(CH_2)_6—OH$ (as the fluorine-containing water repellency-adding material, trademark name : PFA6, produced by NEOS Company Ltd.) of 3.6 parts by weight, to thereby obtain a cleaning blade sample J for test.

Experiment K

The procedures of Experiment A were repeated, except that the water repellency-adding material was changed to alcohol-modified silicone oil (as the silicone series water repellency-adding material, trademark name: SF8427 produced by Toray Dow Corning Silicone Co., Ltd.) of 3.8 parts by weight, to thereby obtain a cleaning blade sample K for test.

Experiment L

The procedures of Experiment A were repeated, except that the amount of each of the polyethylene glycol and 1,4-butanediol was changed to 24.3 parts by weight and 6.1 parts by weight, respectively, and no water repellency-adding material was used, to thereby obtain a cleaning blade sample L for test.

Experiment M

The procedures of Experiment A were repeated, except that as the bifunctional curing agent, 69.8 parts weight of polyethylene glycol was solely used, and the amount of the N-n-propyl-N-2,3-dihydroxypropylperfluorooctylsulfoneamide was changed to 3.9 parts by weight, to thereby obtain a cleaning blade sample M for test.

Experiment N

The procedures of Experiment A were repeated, except that as the bifunctional curing agent, 34.0 parts weight of polyethylene glycol was solely used, and the amount of the N-n-propyl-N-2,3-dihydroxypropylperfluorooctylsulfoneamide was changed to 3.3 parts by weight, to thereby obtain a cleaning blade sample N for test.

Experiment O

The procedures of Experiment A were repeated, except that the polyurethane polymer was replaced by ether series PPG-MD 1 (trademark name: VIBRATHANE B-843, produced by Uniroyal Chemical Company) of 100 parts by weight, as the bifunctional curing agent, 2.3 parts by weight of ethylene glycol and 9.3 parts by weight of 1,6-hexanediol were used, and the amount of the N-n-propyl-N-2,3-dihydroxypropylperfluorooctylsulfoneamide was changed to 2.9 parts by weight, to thereby obtain a cleaning blade sample 0 for test.

Experiment P

The procedures of Experiment A were repeated, except that the polyurethane polymer was replaced by ether series PTMEG-HMD 1 (trademark name: ADIPRENE LW520, produced by Uniroyal Chemical Company) of 100 parts by weight, and the amount of the N-n-propyl-N-2,3-dihydroxypropylperfluorooctylsulfoneamide was changed to 3.5 parts by weight, to thereby obtain a cleaning blade sample P for test.

Experiment Q

The procedures of Experiment A were repeated, except that the polyurethane polymer was replaced by ester series EA-MD 1 (trademark name: CORONATE C4369, produced by Japan Polyurethane Company) of 100 parts by weight, as the bifunctional curing agent, 1.5 parts by weight of 1,4-butanediol and 5.9 parts by weight of 1,6-hexanediol were used, and as the water repellency-adding material, 3.2 parts by weight of MF100 (trademark name, produced by Mitsubishi Materials Corporation) was used, to thereby obtain a cleaning blade sample Q for test.

Experiment R

The procedures of Experiment A were repeated, except that the polyurethane polymer was replaced by ester series EA-MD 1 of 100 parts by weight, as the bifunctional curing agent, 1.6 parts by weight of 1,4-butanediol and 6.5 parts by weight of 1,6-hexanediol were used, and no water repellency-adding material was used, to thereby obtain a cleaning blade sample R for test.

Experiment S

The procedures of Experiment A were repeated, except that the polyurethane polymer was replaced by ester series EA-MD 1 of 100 parts by weight, as the bifunctional curing agent, 4.0 parts by weight of 1,4-butanediol was solely used, 1.0 part by weight of trimethylolpropane (trifunctional curing agent) was used as the polyfunctional curing agent, and as the water repellency-adding material, 3.1 parts by weight of MF100 was used, to thereby obtain a cleaning blade sample S for test.

Experiment T

The procedures of Experiment A were repeated, except that as the bifunctional curing agent, 5.8 parts by weight of 1,4-butanediol was solely used, 1.4 parts by weight of trimethylolpropane was used as the polyfunctional curing agent, and no water repellency-adding material was used, to thereby obtain a cleaning blade sample T for test.

Experiment U

The procedures of Experiment A were repeated, except that the polyurethane polymer was replaced by ester series EA-MD 1 of 100 parts by weight, as the bifunctional curing agent, 4.8 parts by weight of 1,4-butanediol was solely used, 1.2 part by weight of trimethylolpropane was used as the polyfunctional curing agent, and no water repellency-adding material was used, to thereby obtain a cleaning blade sample U for test.

Experiment V

The procedures of Experiment A were repeated, except that hydrogenated nitrile rubber of G-655 (trademark name, produced by Japan Oil Seal Company), to thereby obtain a 0.7 mm thick sheet, which was followed by die cutting, whereby a cleaning blade sample V for test was obtained.

Experiment W 100 parts by weight of silicone rubber SH861U (trademark name, produced by Toray Dow Corning Silicone Co., Ltd.) was mixed with 2 parts by weight of a curing agent RC4 (trademark name, produced by Toray Dow Corning Silicone Co., Ltd.) to obtain a mixture, which was followed by subjecting press molding using a die, to obtain a 0.7 mm thick sheet. The resultant was subjected to die cutting in the same manner as in Experiment A, to thereby obtain a cleaning blade sample W for test.

As for each of the cleaning blade samples A to W obtained in Experiments A to W, evaluation was made with respect to surface roughening situation, abrasion resistance, head damaging resistance, ink pulling-out property, and the quality of a recorded image obtained using an ink jet recording apparatus of the constitution shown in FIG. 8.

Herein, explanation will be made of the ink jet recording apparatus used for conducting the above evaluation.

FIG. 8 is a schematic slant view illustrating the principal part of an embodiment of an ink jet recording apparatus which is provided with one of the foregoing cleaning blade member samples.

In the figure, reference numeral 501 indicates a detachable cartridge type ink jet recording head which is provided with a plurality of ink discharging outlets opposite the recording face of a recording sheet transported on a platen 507. Numeral reference 502 indicates a carriage (HC) for holding the IJC 501 thereon. The carriage is to part of a driving belt 504 which serves to transmit a driving force from a driving motor 503, and it is designed such that it can be moved while sliding on a pair of guide shafts 505 and 506 with each other. By this, the ink jet recording head is made capable of moving back and forth along the entire width of the recording sheet.

Numeral reference 508 indicates a recovery device which is disposed at a given position within the range in which the IJC 501 is moved, specifically, for example, at a position opposite the home position. The recovery device 508 performs capping to the discharging outlets of the IJC 501 by driving a driving force through a driving mechanism 509 from a motor 510. In connection with the capping performance to the discharging outlets of the IJC 501 by means of a cap 511 of the recovery device 508, there is performed suction of ink from the discharging outlets by means of an appropriate aspirator (not shown) installed in the recovery device 508 or force feed of ink by means of appropriate pressure means (not shown) mounted to the ink supply path of the IJC 501. By this, ink is forced to discharge through the discharging outlets to thereby conduct recovery treatment including removal of foreign matters such as viscid ink material present in the inside of each of the discharging outlets. And by conducting capping to the discharging outlets upon completing the recording, the recording head can be protected.

Numeral reference 512 indicates a cleaning blade according to the present invention which is disposed at a side face of the head recovery device 508. The cleaning blade 512 is held at a blade holding member 513 in the form of a cantilever boom, and it is operated, as well as in the case of the recovery device 508, by means of the motor 510 and the driving mechanism 509 so as to encounter the discharging outlet face of the IJC 501. By this, the cleaning blade 512 is projected in the range in which the IJC 501 is moved on appropriate timing during the recording operation by the IJC 501 or after recovery treatment by using the recovery device 508, whereby dew drops, moisture, dusts or the like deposited on the discharging outlet face of the IJC can be swabbed.

Independently, as for each of the cleaning blade member samples, evaluation was conducted with respect to rubber hardness under the JISA, existence state of the water repellency-adding material, ink contact angle, and ink modification. In the following, description will be made of the manner of evaluating each of the evaluation items.

(1) Evaluation of the rubber hardness:

The measurement of the rubber hardness was conducted in accordance the rubber hardness measuring method described in the JIS (Japan Industry Standard) A. The measured results obtained are shown in Table 1.

(2) Evaluation of the existence state of the water repellency-adding material:

The cross sectional face of the cleaning blade member sample which was resulted when the sheet member was cut was observed by eyes using a microscope.

The observed results are shown in Table 1, in which the sample for which the existence of particles of the water repellency-adding material was observed is shown by the term "particle", and the sample for which the existence of particles of the water repellency-adding material was not observed is shown by the term "compatible".

(3) Evaluation of the ink contact angle:

As for each of the cleaning blade member samples A to W, the ink contact angle was measured by means of a contact angle meter (trademark name : A-Z150, produced by Kyowa Kaimenkagaku Kabushiki Kaisha), wherein aqueous ink composed of 23 wt. % of C.I. Food Black, 25 wt. % of diethylene glycol, 20 wt. % of N-methyl-2-pyrrolidone, and 52 wt. % of water (this ink will be hereinafter referred to as use ink) was used. The measured results obtained are shown in Table 1. In Table 1, the measured result shown in the column "initial stage" is of the ink contact angle measured for the cleaning blade sample prior to practical use in the cleaning operation. Similarly, the measured result shown in the column "after ink swelled" is of the ink contact angle measured after the cleaning blade sample has been immersed in the use ink for 10 days.

(4) Evaluation of the ink modification:

Each cleaning blade sample was immersed in the use ink for 3 months, and the ink used therein was subjected to composition analysis using a gas chromatography (trademark name: GC-9A, produced by Shimadzu Seisakusho Ltd.). The analyzed ink composition was compared with the composition of the use ink before used. The observed results are shown in Table 1, in which the case wherein no modified state was observed is indicated by the mark ◎, the case wherein modified state was substantially not observed is indicated by the mark ○, the case wherein a change was observed in the composition but said change is considered not to negatively influence to an image recorded is indicated by the mark Δ, and the case wherein a significant change was observed in the composition and said change is considered to negatively influence to an image recorded is indicated by the mark X.

(5) Evaluation of the surface roughening situation and abrasion resistance:

Each cleaning blade sample was set to the ink Jet recording apparatus shown in FIG. 8 so as to satisfy the conditions of 8 mm as for the free length of the blade member and 1.5 mm as for the entrance extent into the head. 50 non-ink discharging shots were conducted against the cap. Then, the cycle in which the sequence of conducting one cleaning operation is repeated ten times and thereafter, a given pattern is recorded on a recording sheet was repeated until the frequency of the cleaning operation became 50,000 times, wherein the cleaning operation was conducted at a cleaning speed of 150 mm/sec. and the linear pressure of the cleaning blade member to the discharging outlet face was made to be 5 g/cm. The cleaning blade sample by which 50,000 times cleaning operations had been conducted was observed by eyes using a microscope.

The evaluation of the surface roughening situation was conducted on the basis of the following criteria: ◎ the mark for the case wherein the surface of the cleaning blase sample is not roughened and has no partially worn portion at the edge portion; the mark ○ for the case wherein the surface of the cleaning blade sample is not roughened, slightly worn portions are found at the edge portion, but such slightly worn portions are not problematic upon conducting the cleaning operation; the mark Δ for the case wherein the surface of the cleaning blade sample is roughened, distinguishable worn portions are found at the edge portion, and these defects are likely to slightly influence for the cleaning operation; and the mark X for the case wherein the surface of the cleaning blade sample is roughened, remarkably worn portions are found at the edge portion, and these defects significantly influence for the cleaning operation. The evaluated results are shown in Table 1.

The evaluation of the abrasion resistance was conducted on the basis of the following criteria: the mark ◎ for the case wherein no wear is not found at the edge portion of the cleaning blade sample; the mark ○ for the case wherein a slight wear is found at the edge portion of the cleaning blade sample, but such slight wear is not problematic for the cleaning operation; the mark Δ for the case wherein a distinguishable wear is found at the edge portion of the cleaning blade sample, and the wear is likely to influence for the cleaning operation; and the mark X for the case wherein remarkably worn portions are found at the edge portion of the cleaning blade sample, and such worn portion significantly influence for the cleaning operation. The evaluated results are shown in Table 1.

(6) Evaluation of the head damaging resistance and ink pulling-out property:

As for each of the cleaning blade samples, after the cleaning operation was repeated 50,000 times under the same conditions as in the above evaluation, the peripheries of the discharging outlets of the discharging outlet face of the recording head were observed by eyes using a microscope.

The evaluation of the head damaging resistance was conducted on the basis of the following criteria: the mark ◎ for the case wherein no damage is found at the discharging outlet face of the recording head; the mark ○ for the case wherein there is found a slight damage at the discharging outlet face of the recording head, which is however substantially not problematic for the discharging performance; the mark Δ for the case wherein a few damages are found at the discharging outlet face of the recording head, which are likely to influence for the discharging performance; and the mark X for the case wherein remarkable damages are found at the discharging outlet face of the recording head, which greatly influence for the discharging performance. The evaluated results are shown in Table 1.

The evaluation of the ink pulling-out property was conducted on the basis of the following criteria: the mark ◎ for the case wherein no ink is pulled out; the mark ○ for the case wherein ink is substantially not pulled out; the mark Δ for the case wherein a slight amount of ink is pulled out, but such ink pull-out is likely to slightly influence for the discharging performance; and the mark X for the case wherein a significant amount of ink is pulled out, and such significant ink pull-out greatly influences for the discharging performance. The evaluated results are shown in Table 1.

(7) Evaluation of the quality of an image recorded:

Each cleaning blade sample was set to the ink jet recording apparatus shown in FIG. 8 so as to satisfy the conditions of 8 mm as for the free length of the blade member and 1.5 mm as for the entrance extent into the head. 50 non-ink discharging shots were conducted against the cap. Then, the sequence of conducting one cleaning operation was repeated ten times, and thereafter, a given pattern was recorded on a recording sheet. This cycle was repeated until the frequency of the cleaning operation became 10,000 times, 50,000 times, and 100,000 times, wherein after the repetition of the cleaning operation in these three cases, the recorded state of the recording pattern was evaluated by eyes.

In the above, the cleaning operation was conducted at a cleaning speed of 150 mm/sec., and the linear pressure of the cleaning blade member to the discharging outlet face was made to be 5 g/cm.

The evaluation of the quality of an image recorded was conducted on the basis of the following criteria: the mark ◎ for the case wherein excellent recorded images are provided; the mark ○ for the case wherein practically acceptable good recorded images are provided; the mark Δ for the case wherein a recorded image accompanied by defects due to non-discharging is found as for one or two of 1000 recording sheets; and the mark X for the case wherein a recorded image accompanied by defects due to non-discharging is found almost in every recording. The evaluated results are shown in Table 1.

From the results shown in Table 1, the following facts have been recognized. That is, (i) any of the cleaning blade samples prepared by using polyurethane prepolymer, a curing agent essentially consisting of a bifunctional component, and in addition, a water repellency-adding material is satisfactory with respect to each of the foregoing evaluation items; (ii) of these cleaning blade samples, the cleaning blade samples prepared in the manner that the ratio (OH/NCO) of the molarity of the active element of each of the bifunctional curing agent and water repellency-adding material versus the molarity of the isocyanate group contained in the polyurethane prepolymer is adjusted to be preferably in the range of from 0.80 to 1.05, more preferably in the range of from 0.9 to 1.0 provide a good result with respect to each of the foregoing evaluation items; (iii) especially, the cleaning blade samples prepared in the manner that the water repellency-adding material is added in an amount preferably in the range of from 0.1 to 20 parts by weight, more preferably in the range of from 1 to 10 parts by weight versus 100 parts by weight of the total amount of the polyurethane prepolymer and the bifunctional curing agent provide a markedly excellent result with respect to each of the foregoing evaluation items.

In addition to the above facts, it has been also found that the state of the water repellency-adding material to be contained in the constituent material of the cleaning blade in a compatible state is an extremely important factor in order for the cleaning blade to exhibit and maintain a desirable cleaning function.

TABLE 1

| | Experiment | | | | | | | | | |
|---|---|---|---|---|---|---|---|---|---|---|
| | A | B | C | D | E | F | G | H | I | J |
| polyurethane prepolymer | | | | | | | | | | |
| PTMEG-MD1 NCO content | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % |
| PPG-MD1 NCO cont. 10.0 wt % | | | | | | | | | | |
| PTMEG-HMD1 NCO cont. 7.5 wt % | | | | | | | | | | |
| EA-MD1 esteurethane NCO cont. 6.2 wt % | | | | | | | | | | |
| curing agent | | | | | | | | | | |
| polyethylene glycol molecular weight 100 bifunctional | 22.7 | 23.6 | 21.6 | 24.0 | 18.6 | 14.1 | 19.3 | 23.8 | 22.3 | 22.9 |
| ethylene glycol bifunctional | | | | | | | | | | |
| 1,4-butanediol bifunctional | 5.7 | 5.9 | 5.4 | 6.0 | 4.7 | 3.5 | 4.8 | 6.0 | 5.6 | 5.8 |
| 1,6-hexanediol bifunctional | | | | | | | | | | |
| trimethylolpropane trifunctional | | | | | | | | | | |
| water repellency-adding material | | | | | | | | | | |
| 3-(2-perfuluorohexyl) ethoxy-1,2dihydroxypropane MF100 | | | | | | | | | 3.6 | |
| N-n-propyl-N-2,3-dihydroxypropyl perfluroocthyl sulfoneamide MF110 | 3.6 | 1.3 | 6.3 | 0.2 | 13.4 | 23.5 | 3.2 | 3.8 | | |
| $C_9F_{17}O—(CH_3)_6—OH$ PFA6 | | | | | | | | | | 3.6 |
| alcohol-modified silicone SF8427 | | | | | | | | | | |
| rubber hardness (JISA) | 72 | 71 | 73 | 72 | 75 | 78 | 72 | 72 | 72 | 71 |
| the state where water repellency-adding material is present | compa-tible | compa-tible | compa-tible | compa-tible | compa-tible | grain | compa-tible | compa-tible | compa-tible | compa-tible |
| water repellency ink contact angle (backward contact angle) | | | | | | | | | | |
| initial stage | 102° | 95° | 110° | 85° | 120° | 121° | 100° | 102° | 101° | 100° |
| after ink swelled | 98° | 92° | 106° | 78° | 118° | 118° | 94° | 97° | 96° | 94° |
| resistance to surface roughening | ◎ | ◎ | ◎ | ◎ | ◎ | ○ | ◎ | ◎ | ◎ | ◎ |
| abrasion resistance | ◎ | ◎ | ◎ | ◎ | ◎ | Δ | ◎ | ◎ | ◎ | ◎ |
| the situation of pulling out ink evaluation of recorded image | ◎ | ◎ | ◎ | ○ | ◎ | ◎ | ◎ | ◎ | ◎ | ◎ |
| initial 10,000 shots | ◎ | ◎ | ◎ | ◎ | ◎ | ◎ | ◎ | ◎ | ◎ | ◎ |
| 50,000 shots | ◎ | ◎ | ◎ | ○ | ◎ | Δ | ◎ | ◎ | ◎ | ◎ |
| 100,000 shots | ◎ | ◎ | ◎ | Δ | ○ | X | ○ | ○ | ◎ | ◎ |
| head damaging resistance | ◎ | ◎ | ◎ | ◎ | ◎ | ◎ | ◎ | ◎ | ◎ | ◎ |
| the situation of ink modification | ◎ | ◎ | ◎ | ◎ | ◎ | ◎ | ◎ | ◎ | ◎ | ◎ |

| | Experiment | | | | | | | | |
|---|---|---|---|---|---|---|---|---|---|
| | K | L | M | N | O | P | Q | R | S |
| polyurethane prepolymer | | | | | | | | | |
| PTMEG-MD1 NCO content | 100 NCO 7.7 wt % | 100 NCO 7.7 wt % | 100 NCO 6.4 wt % | 100 NCO 3.2 wt % | | | | | |
| PPG-MD1 NCO cont. 10.0 wt % | | | | | 100 | | | | |

TABLE 1-continued

| | | | | | | | | | |
|---|---|---|---|---|---|---|---|---|---|
| PTMEG-HMD1 NCO cont. 7.5 wt % | | | | | | 100 | | | |
| EA-MD1 esteurethane NCO cont. 6.2 wt % | | | | | | | 100 | 100 | 100 |
| curing agent | | | | | | | | | |
| polyethylene glycol molecular weight 100 bifunctional | 23.8 | 24.3 | 69.8 | 34.0 | | 22.1 | | | |
| ethylene glycol bifunctional | | | | | 2.3 | | | | |
| 1,4-butanediol bifunctional | 5.9 | 6.1 | | | | 5.5 | 1.5 | 1.6 | 4.0 |
| 1,6-hexanediol bifunctional | | | | | 9.3 | | 5.9 | 6.5 | |
| trimethylolpropane trifunctional | | | | | | | | | 1.0 |
| water repellency-adding material | | | | | | | | | |
| 3-(2-perfuluorohexyl) ethoxy-1,2dihydroxypropane MF100 | | | | | | | 3.2 | | 3.1 |
| N-n-propyl-N-2,3-dihydroxypropyl perfluoroocthyl sulfoneamide MF110 | | | 3.9 | 3.3 | 2.9 | 3.5 | | | |
| $C_9F_{17}O—(CH_3)_6—OH$ PFA6 | | | | | | | | | |
| alcohol-modified silicone SF8427 | 3.8 | | | | | | | | |
| rubber hardness (JISA) | 69 | 71 | 62 | 51 | 85 | 67 | 89 | 88 | 63 |
| the state where water repellency-adding material is present | grain | — | compa-tible | compa-tible | compa-tible | compa-tible | compa-tible | — | compa-tible |
| water repellency | | | | | | | | | |
| ink contact angle (backward contact angle) | | | | | | | | | |
| initial stage | 94° | 85° | 100° | 98° | 99° | 105° | 98° | 87° | 101° |
| after ink swelled | 86° | 69° | 94° | 92° | 95° | 100° | 90° | 76° | 94° |
| resistance to surface roughening | ○ | ◎ | ◎ | ◎ | ◎ | ◎ | ◎ | ◎ | X |
| abrasion resistance | ○ | ◎ | ◎ | ◎ | ◎ | ◎ | ◎ | ◎ | ○ |
| the situation of pulling out ink | ◎ | Δ | ◎ | ◎ | ◎ | ◎ | ◎ | Δ | Δ |
| evaluation of recorded image | | | | | | | | | |
| initial 10,000 shot | ◎ | ◎ | ◎ | ◎ | ◎ | ◎ | ◎ | ◎ | ◎ |
| 50,000 shots | ○ | ○ | ◎ | ◎ | ◎ | ◎ | ◎ | ○ | ○ |
| 100,000 shots | Δ | Δ | ○ | ○ | ◎ | ◎ | ◎ | Δ | X |
| head damaging resistance | ◎ | ◎ | ◎ | ◎ | ◎ | ◎ | ◎ | ◎ | ◎ |
| the situation of ink modification | Δ | ◎ | ◎ | ◎ | ◎ | ◎ | ◎ | ◎ | ◎ |

| | Experiment | | | |
|---|---|---|---|---|
| | T | U | V | W |
| polyurethane prepolymer | | | | |
| PTMEG-MD1 NCO content | 100 NCO 7.7 wt % | | nitrile hydro-geated rubber | silicone rubber |
| PPG-MD1 NCO cont. 10.0 wt % | | | | |
| PTMEG-HMD1 NCO cont. 7.5 wt % | | | | |
| EA-MD1 esteurethane NCO cont. 6.2 wt % | | 100 | | |
| curing agent | | | | |
| polyethylene glycol molecular weight 100 bifunctional | | | | |
| ethylene glycol bifunctional | | | | |
| 1,4-butanediol | 5.8 | 4.8 | | |

TABLE 1-continued

| | | | | |
|---|---|---|---|---|
| bifunctional | | | | |
| 1,6-hexanediol | | | | |
| bifunctional | | | | |
| trimethylolpropane | 1.4 | 1.2 | | |
| trifunctional | | | | |
| water repellency-adding material | | | | |
| 3-(2-perfuluorohexyl) ethoxy-1,2dihydroxypropane | | | | |
| MF100 | | | | |
| N-n-propyl-N-2,3-dihydroxypropyl perfluroocthyl sulfoneamide MF110 | | | | |
| $C_9F_{17}O—(CH_3)_6—OH$ | | | | |
| PFA6 | | | | |
| alcohol-modified silicone SF8427 | | | | |
| rubber hardness (JISA) | 70 | 62 | 57 | 60 |
| the state where water repellency-adding material is present | — | — | | |
| water repellency | | | | |
| ink contact angle (backward contact angle) | | | | |
| initial stage | 83° | 85° | 99° | 112° |
| after ink swelled | 67° | 72° | 86° | 110° |
| resistance to surface roughening | X | X | X | Δ |
| abrasion resistance | Δ | ⊙ | X | X |
| the situation of pulling out ink | X | X | X | Δ |
| evaluation of recorded image | | | | |
| initial 10,000 shots | ○ | ○ | ○ | Δ |
| 50,000 shots | X | X | X | X |
| 100,000 shots | X | X | X | X |
| head damaging resistance | ⊙ | ⊙ | Δ | X |
| the situation of ink modification | ⊙ | ⊙ | Δ | X |

EXAMPLES

In the following, examples of the present invention will be described.

There were used the foregoing cleaning blade sample A which has exhibited excellent cleaning blade characteristics and the foregoing cleaning blade sample S which has not exhibited satisfactory cleaning blade characteristics.

Each of the cleaning blade samples was set to an ink jet apparatus of the constitution shown in FIG. 9 which is capable of conducting full-color recording, wherein the cleaning blade member was subjected to durability test by repeating the cleaning operation 50,000 times.

Description will be made of the full-color ink jet apparatus and the procedures of conducting the cleaning operation.

In FIG. 9, numeral reference 101 indicates a head unit which is fixed to a carriage 102. The carriage 102 is supported by a main scanning rail 103 such that it can be moved in the direction of conducting recording.

In the apparatus, for instance, in the case where clogging takes place at a discharging outlet 101*b* of the head unit 101, a holder 301 provided with caps 300 capable of forming an enclosed space for the head unit in the non-recording zone is moved in the direction expressed by an arrow a to contact the cap 300 with a discharging outlet face 101*a*, and it is stopped at a position where the enclosed space can be formed. Under this state, suction recovery is performed by a pump unit 303 trough a tube 302. Ink pulled out from the head unit 101 by way of suction is transported to a ink releasing treatment member 305 through the tube 302. After the suction recovery treatment, the holder 301 provided with the caps 300 is retired in the direction expressed by an arrow b. In this case, ink I pulled out from the discharging outlet 101*b* through the suction recovery remains at the discharging outlet face 101*a*. Herein, by moving the carriage 102, wipping treatment is performed for the discharging outlet face 101*a* by a cleaning blade 401 held on a blade holder 402 (see, FIGS. 9(*b*) and 9(*c*)), whereby the ink I on the discharging outlet face 101*a* can be removed therefrom. A absorbent 104 is fixed to the wipping downstream side of the head unit 101 by means of adhesion or heat calking. In the structure on the head unit side, a tapered portion 101*c* is formed at a given portion of the discharging outlet face 101*a* which is situated next to the absorbent 104 and on the wipping upstream side to the absorbent 104 such that an edge portion of the absorbent 104 is projected.

A slight amount of ink which possibly remains on the cleaning blade 401 is absorbed by a absorbent 105 as a second absorbing member disposed at the carriage 102, whereby it can be completely removed.

Each of the absorbents 104 and 105 is composed of a polyolefin series porous material which is hardly swelled upon absorbing liquid. Examples of such material are those with a swelling degree of 0.01 to 0.02% prepared by subjecting a sintered body of polyethylene to hydrophilizing treatment, specifically, such as SUNFINE AQ (trademark name, produced by Asahi Chemical Industry Co., Ltd.).

Further description will be made with reference to FIGS. 9(*b*) and 9(*c*). The ink I deposited on the discharging outlet face 101*a* during the suction recovery treatment is removed from the discharging outlet face 101*a* by means of the cleaning blade 401 with the movement of the carriage 102. In this case, the ink I is moved together the cleaning blade 401 along the discharging outlet face 101*a* portion to arrive at the tapered portion 101*c* formed at the given portion of the discharging outlet face 101*a*, wherein the ink I is forced to contact with an edge 104*a* of the absorbent 104, whereby the ink I is taken up from the cleaning blade 401, and the ink (ink I') is once stored in the tapered portion 101*c*. Then, the ink I' is instantly absorbed by the absorbent 104 (the state I' in FIG. 9(*b*)). Thereafter, when the carriage 102 is further moved, the cleaning blade 401 is moved while being rubbed with the absorbent 105 of the carriage. In this case, the cleaning blade 401 is moved while a slight amount of ink I" remained on the cleaning blade 401 without being removed by the absorbent 104 being absorbed by the absorbent 105. Because of this, the cleaning blade 401 becomes completely free of the residual ink at its edge portion 401*a* before arriving at the next head unit. By this, there is no occasion for the ink removed from the discharging outlet face 101*a* to influence to the adjacent head unit. Therefore, occurrence of color admixture can be effectively prevented, and the edge portion 401*a* of the cleaning blade 401 can be served for successive wipping treatment always in a clean state.

The edge states of each of the cleaning blade samples A and S after the durability test are shown in FIGS. 10(*a*) and 10(*b*) and FIGS. 10(*c*) and 10(*d*), respectively. As apparent from FIGS. 10(*a*) and 10(*b*), it is understood that the cleaning blade sample A prepared by using the bifunctional curing agent only and the water repellency-adding material is completely from occurrence of surface roughening (see, FIG. 4(*a*)), that it can continuously perform excellent cleaning over a long period of time without being worn (see, FIGS. 5(*a*) and 7(*a*)), and that it does not cause deterioration for the quality of an image recorded. On the other hand, as apparent from FIGS. 10(*c*) and 10(*d*), it is understood that the cleaning blade sample S prepared by using the trifunctional curing agent in a relatively great amount is significantly roughened at its surface while being partially worn (see, 4(*b*)), that it not only damages the discharging outlet face upon the cleaning operation but also causes ink escape (see, FIG. 7(*d*)) or/and ink pull-out (see, FIG. 5(*b*)), and that it cannot continuously perform desirable cleaning over a long period of time, wherein deterioration is caused for the quality of an image recorded.

Effects of the invention

As above described, by using a member prepared by using polyurethane with no addition of an inorganic filler or the like as the principal starting material, and adding a bifunctional curing agent and a water repellency-adding material, there is afforded a cleaning blade which does not damage a discharging outlet face of a recording head and does not have a property of modifying ink; which is hardly worn and is extremely resistant against surface roughening of causing partially broken portions; which excels in water repellency and has a property of releasing ink deposited thereon wherein ink pull-out is not caused; and which continuously exhibits extremely stable cleaing characteristics even upon repeated use over a long period of time.

By using the cleaning blade having such various characteristics, there can be provided a highly reliable ink jet apparatus which enables to conduct high speed recording or full-color recording capable of stably providing high quality recorded images continuously over a long period of time.

BRIEF DESCRIPTION OF THE DRAWINGS

FIG. 5(*b*) is a explanatory view illustrating the state when ink pull-outs from discharging outlets are occurred during the cleaning operation.

FIG. 7(*c*) is a schematic view illustrating the situation when cleaning has been performed in a desirable state; and FIG. 7(*d*) is a schematic view illustrating the situation when cleaning has been performed by a cleaning blade with a partially worn surface.

Figure 1:
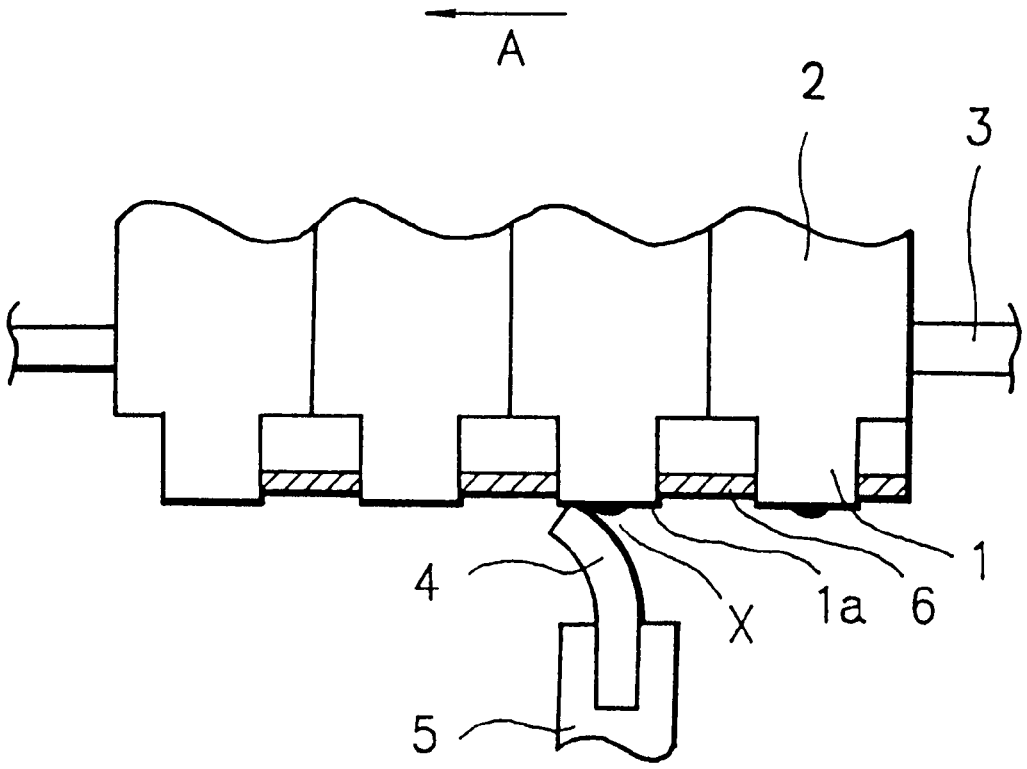
FIG. 1 is a schematic explanatory view illustrating the situation of conducting cleaning by means of a cleaning blade in an ink jet recording apparatus for practicing color recording.

We claim:

1. A cleaning member for removing foreign matter deposited on an ink discharging outlet face of an ink jet recording head for conducting recording on a recording medium by discharging ink, said cleaning member comprising an ether series polyurethane rubber elastic body comprised of:

a polyether polyurethane prepolymer, a curing agent component for said polyether polyurethane prepolymer consisting only of a bifunctional component, and a water repellency-adding material having an active group for chemically bonding to said polyurethane rubber, wherein said curing agent comprises a compound selected from the group consisting of diols, glycols, bisphenols, and diamines, and said water repellency-adding material comprises a compound selected from the group consisting of modified silicone compounds and reactive fluorine-containing compounds.

2. A cleaning member according claim 1, wherein the ink is aqueous ink.

3. A cleaning member according to claim 1, wherein an ink contact angle at a surface of the cleaning member is 80° or above.

4. A cleaning member according to claim 1, wherein an amount of a sum of an active element of the curing agent component and the active group of the water repellency-adding material is present in a molar ratio of 0.8 to 1.05 of an amount of the isocyanate group contained in the polyurethane rubber.

5. A cleaning member according to claim 1, wherein the recording head comprises an ink jet recording system in which recording is conducted by discharging liquid droplets through a discharging element using thermal energy, said ink jet recording system being provided with an electrothermal converting body as a means for generating said thermal energy.

6. A cleaning member according to claim 1, wherein the water repellency-adding material is contained in the polyurethane rubber and the water repellency-adding material is compatible with the polyurethane rubber of the elastic body.

7. A cleaning member according to claim 1, wherein the water repellency-adding material is a fluorine-containing compound.

8. A cleaning member according to claim 1, wherein the water repellency-adding material is present in an amount in a range from 0.1 to 20 parts by weight versus 100 parts by weight of a total amount of the polyurethane rubber and the curing agent component.

9. A cleaning member according to claim 1, wherein said water repellency-adding material is contained in and is compatible with said polyurethane rubber of said elastic body, and said cleaning member has a surface of 80° or above in ink contact angle.

10. A cleaning member according to claim 9, wherein the bifunctional component is a straight-chain diol.

11. A cleaning member according to claim 9, wherein the ink is aqueous ink.

12. A cleaning member according to claim 9, wherein an amount of a sum of an active element of the curing agent component and the active group of the water repellency-adding material is present in a molar ratio of 0.8 to 1.05 of an amount of the isocyanate group contained in the polyurethane rubber.

13. A cleaning member according to claim 9, wherein the water repellency-adding material is a fluorine-containing compound.

14. A cleaning member according to claim 9, wherein the water repellency-adding material is present in an amount in a range of 0.1 to 20 parts by weight versus 100 parts by weight of a total amount of the polyurethane rubber and the curing agent component.

15. An ink jet apparatus provided with a support member for holding an ink jet head for conducting recording on a recording medium by discharging aqueous ink, said support member being provided with a means for scanning between a recording zone wherein said recording medium is transported and a non-recording zone outside said recording zone, and a cleaning blade for cleaning a discharging outlet face of said ink jet head in said non-recording zone, said cleaning blade comprising an ether series polyurethane rubber elastic body comprised of:

a polyether polyurethane prepolymer, a curing agent component for said polyether polyurethane prepolymer consisting only of a bifunctional component, and a water repellency-adding material having an active group for chemically bonding to said polyurethane rubber, wherein said curing agent comprises a compound selected from the group consisting of diols, glycols, bisphenols, and diamines, and said water repellency-adding material comprises a compound selected from the group consisting of modified silicone compounds and reactive fluorine-containing compounds.

16. An ink jet apparatus according to claim 15, wherein said water repellency-adding material is contained in and is compatible with said polyurethane rubber of said elastic body, and said cleaning blade has a surface of 80° or above in ink contact angle.

* * * * *

UNITED STATES PATENT AND TRADEMARK OFFICE

CERTIFICATE OF CORRECTION

PATENT NO. : 6,176,565 B1 
DATED : January 23, 2001
INVENTOR(S) : Noriyuki Yanai et al.

It is certified that error appears in the above-identified patent and that said Letters Patent is hereby corrected as shown below:

Delete columns 1-28 and substitute therefore columns 1-28 as shown on the attached pages.

Signed and Sealed this

Sixth Day of May, 2003

JAMES E. ROGAN
*Director of the United States Patent and Trademark Office*

CLEANING MEMBER FOR INK JET AND INK JET APPARATUS PROVIDED WITH SAID CLEANING MEMBER

This application is a continuation of application Ser. No. 08/050,451 filed Oct. 4, 1993 now abandoned which is a 371 of PCT/JP92/01163 filed Sep. 11, 1992.

FIELD OF THE INVENTION

The present invention relates to an improved cleaning member for removing foreign matters deposited at the discharging outlet face of an ink jet head for performing recording by discharging ink and to an ink jet apparatus provided with said cleaning member. The cleaning member is constituted by a material comprising a polyurethane prepolymer, a bifunctional curing agent, and a water repellency-adding material. The cleaning member surpasses known cleaning members especially in cleaning durability.

BACKGROUND OF THE INVENTION

According to an ink jet system described in U.S. Pat. No. 4,723,129 or U.S. Pat. No. 4,740,796, recording with a high density and a high definition and of a high quality can be conducted at a high speed. According to this ink jet system, color recording can be attained. The recording head in this ink jet system can be prepared utilizing the techniques in the field of semiconductors. The apparatus can be, therefore, relatively easily miniaturized.

In such an ink jet system, an ink jet head provided with a plurality of ink discharging outlets of an extremely minute size is used. Upon conducting recording using such an ink jet head, ink is discharged through the ink discharging outlets upon the application of a recording signal to spatter and deposit on a record medium, thereby achieving the recording.

The conventional ink jet head is either of the so-called continuous type in which ink is continuously discharged such that the ink is selectively deposited on a record medium or of the so-called on-demand type in which only droplets of ink necessary for recording are intermittently discharged to a record medium.

As for the on-demand type ink jet head, there are typically known a full-line type ink jet head in which a plurality of ink discharging outlets are arranged to correspond to the width of a record medium, and a serial scanning type ink jet head in which recording is conducted by moving the head in relation to a record medium.

Incidentally, as for an ink jet apparatus having such an ink jet head as above described, there are still such shortcomings to be solved as will be described in the following. That is, in the case of conducting recording by using an ink jet head provided with a plurality of discharging outlets of a minute size through which ink is discharged in fine-grained form, dirt or dust present in the recording apparatus, paper powder resulting from a record medium, or droplets of ink are likely to deposit on a discharging outlet face 1*a* provided with discharging outlets 1*b* or at positions in the vicinity of the discharging outlets as shown in FIGS. 7(*a*) and 7(*b*). These deposits often hinder the direction of flight of droplets discharged from the discharging outlets, or they are sometimes dried and solidified to plug up some of the discharging outlets such that ink cannot be not discharged through those discharging outlets.

In order to eliminate these problems, there has been proposed a so-called blade cleaning method wherein the discharging outlet face deposited with such foreign matter is brushed by means of a blade made of an elastic material such as polyurethane rubber, polyester-urethane rubber, hydrogenated nitrile rubber, or silicone rubber to remove the foreign matter from the discharging outlet face.

Now, there is an increasing demand not only for a mono-color ink jet recording apparatus but also for a multi-color ink jet recording apparatus provided with four individual ink jet heads respectively capable of discharging ink of a different color of yellow, magenta, cyanogen, or black. In the case of the recording in which color tone is varied using these four inks of a different color, it is necessary to discharge a plurality of different inks as for a dot and because of this, better discharging accuracy is required than that in the case of conducting recording using a mono-color ink jet recording apparatus. Therefore, it is necessary for the discharging outlet face of each of the recording heads, which discharge individual ink of a different color, to be maintained in a cleaned state so that stable ink discharging is always provided. For this purpose, the cleaning reliability by means of the blade cleaning must be maintained.

As for the cleaning blade used in such full-color recording apparatus, there are known a configuration in which an independent cleaning blade is installed in each of the recording heads and another configuration in which a common cleaning blade is installed in the apparatus so that each of the recording heads can be cleaned by the common cleaning blade. From the viewpoint of reducing the area occupied by the cleaning blade in the recording apparatus as much as possible in order to miniaturize the size of the recording apparatus, the manner of cleaning each of the four recording heads by a common cleaning blade is the most desirable. However, in this cleaning manner of cleaning the individual recording heads continuously discharging different inks by a common cleaning blade, there is a tendency that those different inks are mixed on the cleaning blade to result in causing the formation of an image defective in color tone.

In order to eliminate this problem, there has been proposed a manner in which the cleaning is conducted successively from the recording head of discharging ink of relatively light color to the recording head of discharging ink of dark color to prevent occurrence of ink admixture at the recording head of discharging light color ink.

Another manner has been proposed in which an ink absorbent is disposed between each adjacent color ink jet heads, after one of the heads has been cleaned by a cleaning blade, ink deposited on the cleaning blade is removed by the ink absorbent, wherein the next head can be cleaned by the cleaning blade without suffering from any negative influence from the previously cleaned head.

In the following, description will be made of the latter cleaning manner with reference to FIG. 1. As apparent in FIG. 1, a main scanning carriage 2 provided with ink jet heads 1 is designed to travel on a main scanning rail 3. In the non-recording zone separate from the recording zone in the apparatus, a cleaning blade 4 is arranged such that it contacts with a discharging outlet face la of the ink jet head 1. Reference numeral 5 indicates a holder which serves to fix the cleaning blade 4. By moving the main scanning carriage 2 in the direction expressed by mark A, the discharging outlet face 1*a* is rubbed by the cleaning blade 4 arranged in the non-recording zone, whereby deposits X such as ink droplets, paper powder, dust, and the like which are deposited on the discharging outlet face 1*a* are removed by the action of an edge of the cleaning blade 4. The ink deposited on the cleaning blade 4 is removed by an ink absorbent 6 which is disposed between each adjacent ink jet head. Thus, the cleaning blade 4 in the cleaned state can serve to clean the next ink jet head. In this manner, all the individual recording heads of discharging ink of a different color can desirably be cleaned by the cleaning blade in a cleaned state without causing admixture among the different inks. In this cleaning manner, the cleaning blade is rubbed with the discharging outlet face as many times as the number of the ink jet heads in one cleaning operation cycle and therefore, the frequency of the cleaning blade to be rubbed is greater than that in other cleaning manners.

Independently, in recent years, research and development have been made not only of high speed recording but also of the manner which enables high-volume recording by a single recording apparatus comprising an ink jet recording head of the head-exchangeable type in which viewpoints as will be described in the following.

For instance, in the case of the high speed ink jet recording apparatus, since the amount of ink to be discharged in terms of unit hour becomes unavoidably great, ink becomes more liable to deposit on the discharging outlet face of the recording head. In order to avoid occurrence of this problem, it is necessary to shorten the timing of the cleaning of the recording head and to frequently conduct the cleaning.

In the case of the ink jet recording apparatus which enables high-volume recording, when the apparatus is repeatedly used over a long period of time while exchanging the recording head many times, the frequency of using the cleaning blade in order to clean those recording heads unavoidably becomes extremely great.

Thus, it is understood that the cleaning operation cycle in such ink jet recording apparatus as above described is repeated a great many times. Particularly, in the case of the foregoing color recording, as described in the above with reference to FIG. 1, since the cleaning blade is rubbed not only with the discharging outlet face of the recording head but also with the ink absorbent, the frequency of the cleaning blade to be rubbed becomes significantly great. In view of this, it is desired for the cleaning blade to be further improved in terms of durability.

Now, there are known various cleaning blades to be used in the blade cleaning method which are constituted by an elastic material such as silicone rubber, hydrogenated nitrile rubber, polyester-urethane rubber, or polyether-urethane rubber.

However, any of these materials has problems such as will be described herein.

That is, silicone rubber is relatively poor in abrasion resistance. Because of this, when rubbed continuously with the ink jet head and the ink absorbent, the silicone rubber member is gradually worn and as a result, the cleaning which is conducted utilizing an edge portion of the cleaning blade becomes insufficient. In this case, the worn cleaning blade permits ink to pass through its portion in contact with the discharging outlet face of the head, wherein foreign matter deposited cannot be sufficiently removed. This leads to causing problems such that the residual ink or foreign matter left without having been removed prevents ink from being stably discharged through the discharging outlets, wherein stable flight orbit of the ink particle cannot be attained, resulting in providing defective recorded images accompanied by blurred portions or lines or that the discharging outlets of the ink jet head are clogged with powdery materials generated when the cleaning blade is worn, resulting in providing defective recorded images accompanied by lines. Other than these problems, there is also a problem in that inorganic fillers such as silica contained in the silicone rubber sometimes damage portions near the discharging outlets of the ink jet head upon conducting the cleaning by the cleaning blade, resulting in preventing ink from being stably discharged while providing flight orbit of ink particle as desired, wherein defective recorded images are provided. Further, oily components contained in the silicone rubber are liable to modify the composition of ink, wherein the ink is hardly bubbled, resulting in providing defective recorded images accompanied by undischarged lines caused due to insufficient ink bubbling.

In the case where the silicone rubber cleaning blade is employed for cleaning an ink jet system in which droplets of ink are discharged through a discharging element utilizing thermal energy, the foregoing oily components of the silicone rubber are liable to enter into the discharging outlets, wherein the head generating body, which serves to generate thermal energy, is liable to be sintered because of those oily components, resulting in preventing ink from being discharged, and as a result, there cannot be obtained desirable recorded images.

The hydrogenated nitrile rubber is relatively poor in abrasion resistance, like the silicone rubber. In the case where the cleaning blade constituted by the hydrogenated nitrile rubber is employed for cleaning the foregoing color ink jet recording apparatus provided with the ink absorbents, significant wear is caused at the cleaning blade when continuously used over a long period of time as a result of having been repeatedly rubbed with the ink jet heads and the ink absorbents, wherein the cleaning cannot be sufficiently conducted, resulting in leaving ink deposits or other deposited foreign matter without being removed and as a result, desirable ink discharging accuracy cannot be attained, resulting in providing defective recorded images. Because of this, the cleaning blade constituted by the hydrogenated nitrile rubber is problematic especially in terms of durability. The hydrogenated nitrile rubber usually contains oily components for the purpose of improving its hardness. These oily components are liable to enter into the recording heads, wherein there are problems such that their heat generating body is liable to be sintered because of the oil components or the composition of ink is liable to be modified as well as in the case of using the silicone rubber.

Now, urethane rubbers such as polyester-urethane rubber and polyether-urethane rubber are presently often used as a constituent material of the cleaning blade since they are not necessary to be incorporated with either an inorganic filler or an oily component, and they are free of the foregoing problem of damaging the discharging outlet face due to the filler and of the foregoing problems due to the oil components, and are relatively satisfactory in terms of durability when used as the cleaning blade.

Figure 4A:
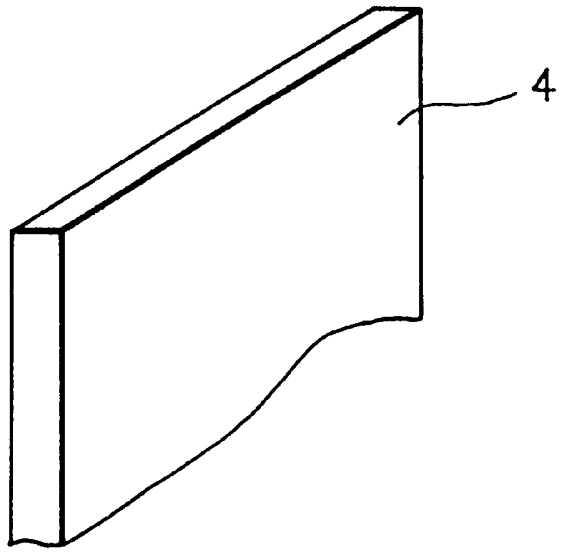
FIG. 4 contains views respectively illustrating the state of a cleaning blade after repeatedly used, in which FIG. 4(*a*) shows a cleaning blade excelling in surface roughening resistance, and FIG. 4(*b*) shows a cleaning blade with a roughened surface which is poor in surface roughening resistance.
Figure 4B:
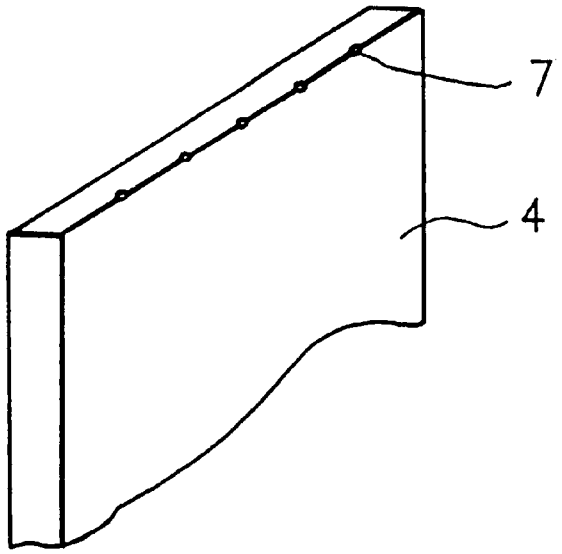

However, in the case where the cleaning blade constituted by such urethane rubber is employed for cleaning the full-color ink jet apparatus shown in FIG. 1, there is a problem in that when the cleaning blade is continuously and repeatedly rubbed with the four ink jet heads and ink absorbents, such partially worn portions as shown in FIG. 4(*b*) are liable to occur at the edge portion of the cleaning blade to provide an unevenly worn state (a face state provided with irregularities). With the cleaning blade having such an unevenly worn state at the edge portion, satisfactory cleaning cannot be attained in the cleaning operation, wherein ink-escape 10B is caused through such a partially worn portion as shown in FIG. 7(*d*), resulting in leaving ink deposits in the vicinity of the discharging outlets without being removed. Such residual ink deposits in the vicinity of the discharging outlets are apt to cause so-called gap defect wherein flight orbit of ink discharged from the discharging outlets is defective. Further, in the case where the unevenly worn state is enlarged and the amount of such ink deposits left without being removed is increased, ink discharged is sometimes taken into the ink deposits, resulting in causing a situation such that ink is not discharged, that is, no image is recorded. In addition, in the case where an unevenly worn state occurs at the edge portion of the cleaning blade, the urging pressure by the cleaning blade is centralized at other edge portion thereof with no broken portion and as a result, the area to be contacted with ink (that is, the meniscus portion) is increased, resulting in promoting the situation of pulling out ink from the discharging outlets (see, FIG. 5(*b*)).

Particularly, as for polyester-urethane rubber, it is liable to cause hydrolysis because of its structure and thus, it is liable to deteriorate due to moisture of the air. In the case where the cleaning blade constituted by this rubber is used in an ink jet recording apparatus in which aqueous ink is used, there is a fear that the rubber is deteriorated due to moisture of the ink to lose its elasticity, resulting in not providing a desired urging force to the edge portion of the cleaning blade upon conducting the cleaning operation. Thus, the cleaning blade is poor in durability upon repeated use over a long period of time.

The foregoing urethane rubbers have at least a polar group in their structure. Because of this, as for the cleaning blade constituted by such urethane rubber, the constituent urethane rubber is liable to absorb aqueous ink used in an ink jet recording head. Particularly, the cleaning blade is continuously contacted with such ink over a long period of time, the constituent urethane rubber becomes swelled because of the ink. This situation results in causing various problems. That is, the cleaning blade pulls out ink in the discharging outlets by virtue of the affinity upon conducting the cleaning (see, FIG. 5(*b*)), wherein ink remains in the vicinity of the discharging outlets without being removed. Such residual ink affects the direction of ink discharged to deteriorate the discharging accuracy, wherein the foregoing gap defect is caused. Other than this, the residual ink remaining on the cleaning blade often becomes such that it is hardly removed after the cleaning and thus, it fouls the blade and reduces its cleaning efficiency in successive cleaning operation. Especially, in the case where the cleaning blade is used in an ink jet recording apparatus in which a plurality of inks having a different color are used, off-shade often occurs due to such deterioration in discharging accuracy. In addition to this, at the stage where the residual ink taken up by the cleaning blade is removed by the ink absorbent, when the cleaning blade has a strong affinity with the ink, sufficient removal of the ink cannot be attained, resulting in undesirable color muixture.

The above problems relating to the cleaning blades are not so serious, for example, in the case of a personal type ink jet recording apparatus in which the number of recording sheets used per recording is not large and which is not frequently used. Particularly, as for the personal type ink jet recording apparatus, it is usually of a system in which recording is conducted with one ink, and the number of recording sheets used per recording is small and in addition, it is usually not used such that the cleaning is necessary to be frequently conducted.

On the other hand, in the foregoing full-color type recording apparatus, high speed recording apparatus or long-time usable recording apparatus of the recording head exchangeable type, the use frequency of the cleaning blade is higher than that in the case of using of the personal type recording apparatus in view of restoring or improving the quality of an image recorded, and a high reliability and durability are required for the cleaning blade. Particularly in the case of the full-color recording apparatus, as above described, since the cleaning blade is continuously rubbed with a plurality of recording heads and a plurality of ink absorbents in one cleaning operation, and the frequency of the cleaning blade to be rubbed with the recording heads and the ink absorbents is extremely increased, and therefore, the cleaning blade is required to be satisfactory in terms of reliability and durability.

Under such circumstance as above described, the present invention is intended to provide a material suitably usable as the cleaning blade for the recording head which is installed in a recording apparatus for which provision of a high quality recorded image is required and which is continuously used over a long period of time.

The present inventors made various studies in order to eliminate the foregoing problems in the prior art. The studies by the present inventors were conducted while focusing on the polyurethane rubber materials above illustrated as the constituent material of the cleaning blade, from the viewpoint that it is not necessary to incorporate into the polyurethane rubber materials are not necessary to be incorporated with inorganic fillers or/and oily components which are apt to give negative influences not only to ink but also to the recording head as above described, and they are relatively good in abrasion resistance. The present inventors conducted various experimental studies with respect to these polyurethane materials while selecting their constituent material, and changing and adjusting an additive to be incorporated. As a result, there were obtained such knowledge that will be described in the following.

Firstly, description will be made of the knowledge obtained with respect to improvement in abrasion resistance of the cleaning blade. In general, as the curing agent for polyurethane rubber, there are used a bifunctional component as a chain-lengthening agent and a polyfunctional (which means trifunctional or more) component as a cross-linking agent ate used. The polyfunctional component serves to prevent occurrence of slide, deviation or the like among adjacent molecules when the rubber is applied with a deformation stress. This makes it possible to form a rubber which is free of permanent deformation and which is small in pressure permanent distortion. However, the polyfunctional component constrains movements of the adjacent molecules not only to prevent the polar groups in the urethane rubber from being mutually reacted (agglomeration) but also to prevent the backbone chain molecules in the urethane rubber from being mutually reacted (crystallization). This results in reducing the strength (tear propagation strength and tensile yield strength) of the rubber. Especially, in the case of polyether-urethane rubber, a distinct difference is provided with respect to tear propagation strength and tensile yield strength depending upon whether the polyfunctional component is present or not present.

The results obtained as a result of the studies by the present inventors showed that the state of being worn differs depending upon whether a polyfunctional component is present or not present. Particularly, the present inventors studied abrasion by providing a cleaning blade comprised of a polyether-urethane rubber with a composition containing a polyfunctional component, setting the cleaning blade to an ink jet recording apparatus of the constitution shown in FIG. 8, and operating the apparatus. As a result, such partially worn portions (chippings) as shown FIG. 4(*b*) occurred at the cleaning blade that had been rubbed with the discharging outlet face of the recording head, those worn portions of the cleaning blade being in unevenly worn state. The same procedures have been repeated, except that a cleaning blade comprised of a polyether-urethane rubber containing only a bifunctional component was used. The results showed that the cleaning blade has such a uniformly worn face as shown in FIG. 4(*a*) with no accompaniment of such partially worn portions.

This difference in terms of worn state of the cleaning blade is for the ink jet recording head. That is, in the case where an unevenly worn state due to such chippings as shown in FIG. 4(*b*) has occurred at the cleaning blade, upon conducting the cleaning operation, ink-escape 10B is caused through such partially worn portions as shown in FIG. 7(*d*) to cause ink to remain in the vicinity of the discharging outlets, wherein such residual ink leads to causing defects in the recording such as gap defect or non-discharging wherein no recorded image is provided. In addition, in the case where such partially worn portions occur at the edge portion of the cleaning blade, the urging pressure by the cleaning blade is centralized at another edge portion thereof with no accompaniment of such partially worn portion, resulting in promoting the situation of pulling out ink from the discharging outlets (see, FIG. 5(*d*)).

On the other hand, in the case of using the cleaning blade comprised of the bifunctional component-containing polyether-urethane rubber, the cleaning blade is rubbed to provide a uniformly worn face at the edge portion with no accompaniment of such partially worn portions. Therefore, no ink-escape occurs, and a uniform urging force is provided by the cleaning blade, wherein the amount of ink to be pulled out from the discharging outlets can be minimized, and the cleaning can be conducted in good state as shown in FIG. 7(*c*).

Herein, description will be made of the situation wherein ink is pulled out from the discharging outlets with reference to FIGS. 2 and 3.

A cleaning blade 7 which serves to rub the ink discharging outlet face 1*a* of the recording head is pressed at a relevant pressure. Therefore, if the cleaning blade 4 is accompanied by such broken portions as above described at the edge portion thereof, a stress is centralized at other edge portion thereof with no partially worn portion. In this case, there is a tendency that the edge portion with no partially worn portion of the cleaning blade 4 enters into the inside of an ink discharging outlet 1*b* in such a state as shown in FIG. 2. Incidentally, at the ink discharging outlet 1*b*, there is formed a meniscus M due to a given surface tension possessed by the ink present in the ink pathway and a negative pressure applied to the ink.

When the edge portion of the cleaning blade 4 at which the stress is centralized enters into the inside of the ink discharging outlet as above described, the edge portion occasionally contacts with the meniscus portion M according to the entrance extend of the edge portion. If the cleaning blade is moved under the state thus contacted, the ink in contact with the cleaning blade is eventually pulled out from the discharging outlet (see, FIG. 5(*b*)). Herein, the residual ink present between the cleaning blade 4 and the discharging outlet 1*a* of the recording head indicates the ink taken up by the cleaning operation.

On the other hand, in the case of the cleaning blade comprised of the polyether-urethane rubber containing a bifunctional component only as the curing agent, since no broken portion occurs at the edge portion thereof and no stress centralization occurs, such a phenomenon that the edge portion of the cleaning blade enters into the inside of the discharging outlet 1*b* of the recording head hardly occurs. If the edge portion of the cleaning blade should enter into the inside of the discharging outlet of the recording head, the entrance extend is extremely small, wherein there is a slight occasion for the edge portion to be contacted with the meniscus M. In addition, in the case of using the cleaning blade comprised of the polyether-urethane rubber containing a bifunctional component only as the curing agent, a uniformly worn state is provided at the edge portion thereof. Therefore, as shown in FIG. 3, if the cleaning blade should be worn, the edge portion of the cleaning blade hardly enters into the inside of the discharging outlet 1*b* of the recording head. If the abraded edge portion of the cleaning blade should enter into the inside of the discharging outlet of the recording head, the entrance extend is extremely small, wherein there is a slight occasion for the edge portion to be contacted with the meniscus M. This means that ink is hardly pulled out from the discharging outlet upon conducting the cleaning operation.

Other than the above knowledge, the present inventors obtained the following knowledge in view of the necessity of improving the water repellency of the cleaning blade.

Figure 2:
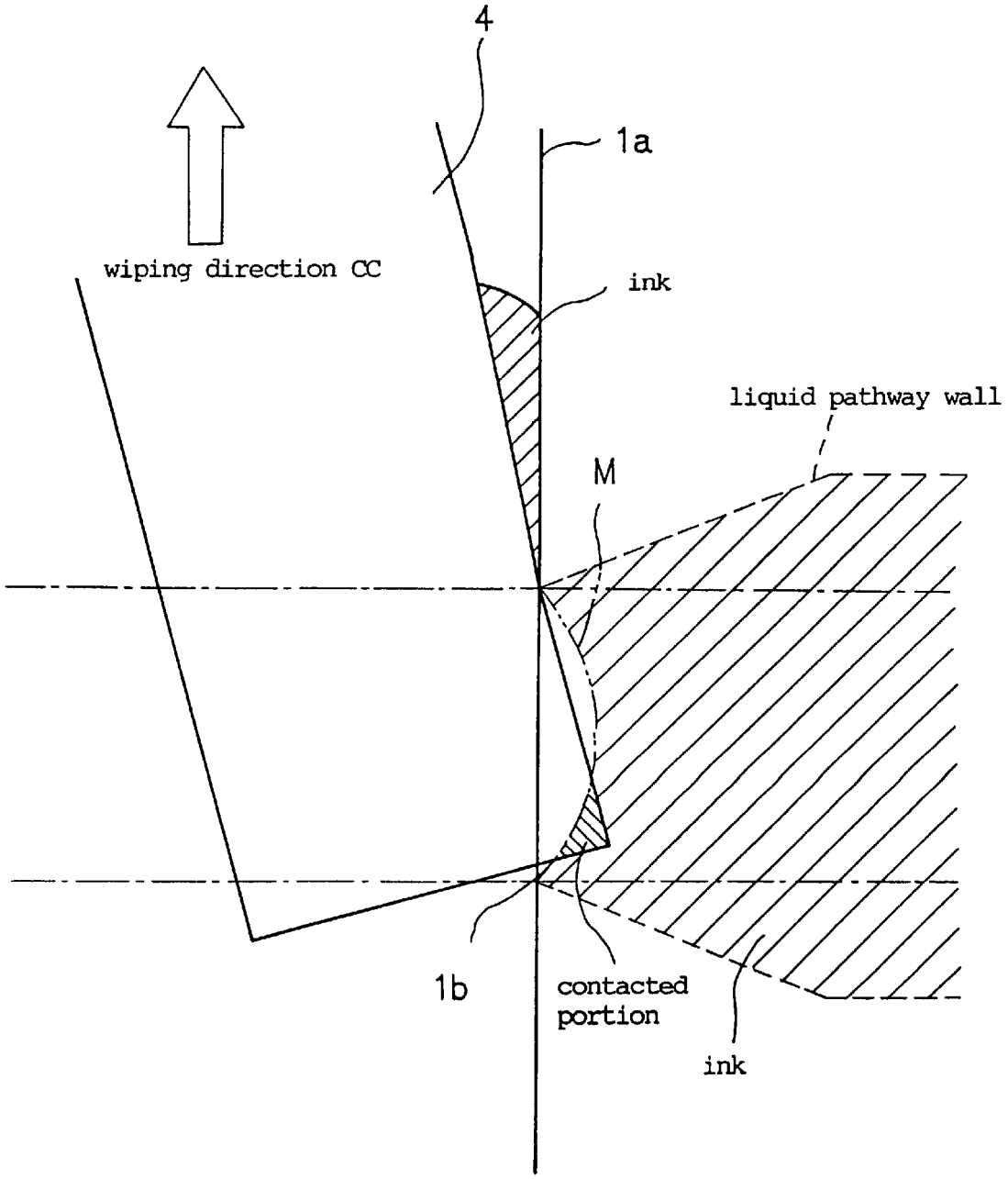
FIG. 2 is a schematic explanatory view illustrating the situation when the edge portion of a cleaning blade enters into a discharging outlet of a recording head to pull out ink.

The phenomenon shown in FIG. 2 in which during the cleaning operation, the cleaning blade 4 enters into the inside of the discharging outlet 1*b* of the recording head and it contacts with the meniscus M of ink formed in the discharging outlet to pull out the ink deposited on the cleaning blade from the discharging outlet along with the movement of the cleaning blade (wherein the amount of the ink to be pulled out is different depending upon the self surface tension of the ink and the water repellency of the cleaning blade) differs also depending upon the water repellency of the cleaning blade.

Figure 5A:
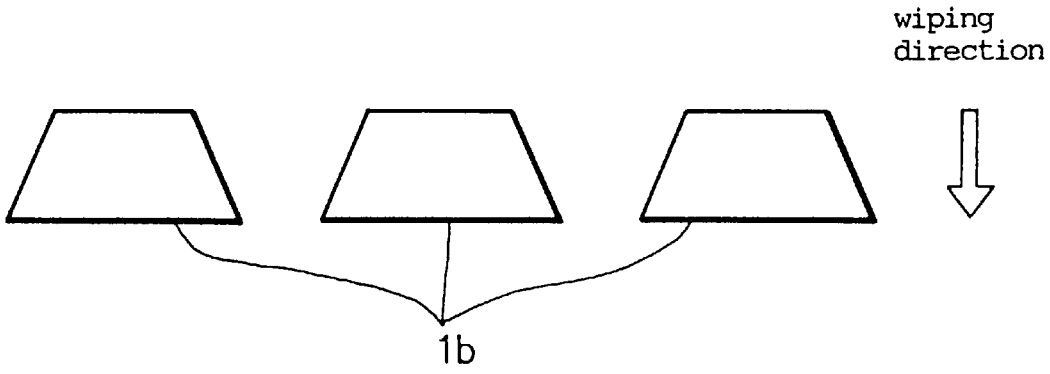
FIG. 5(*a*) is a schematic explanatory view illustrating the state when cleaning has been performed in a desirable state.
Figure 5B:
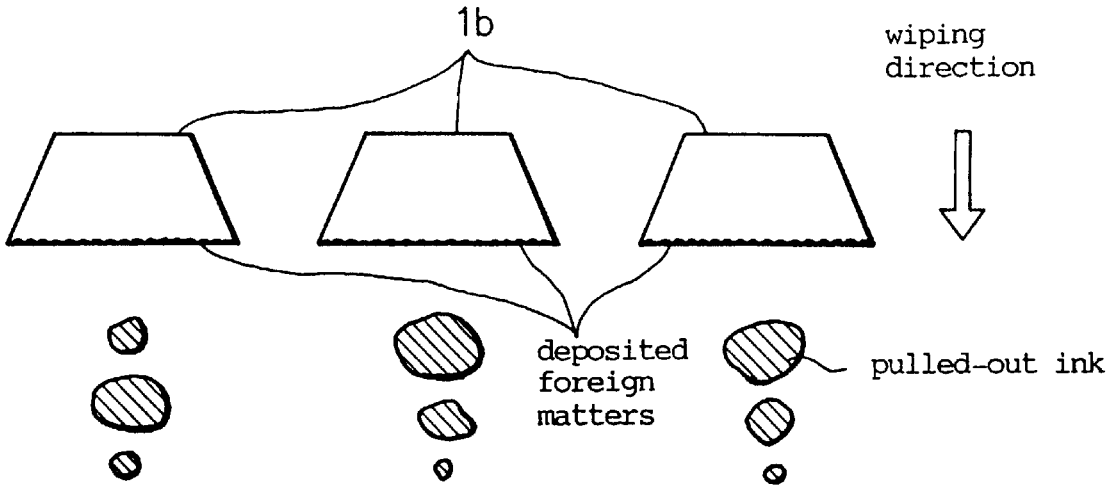
Figure 6:
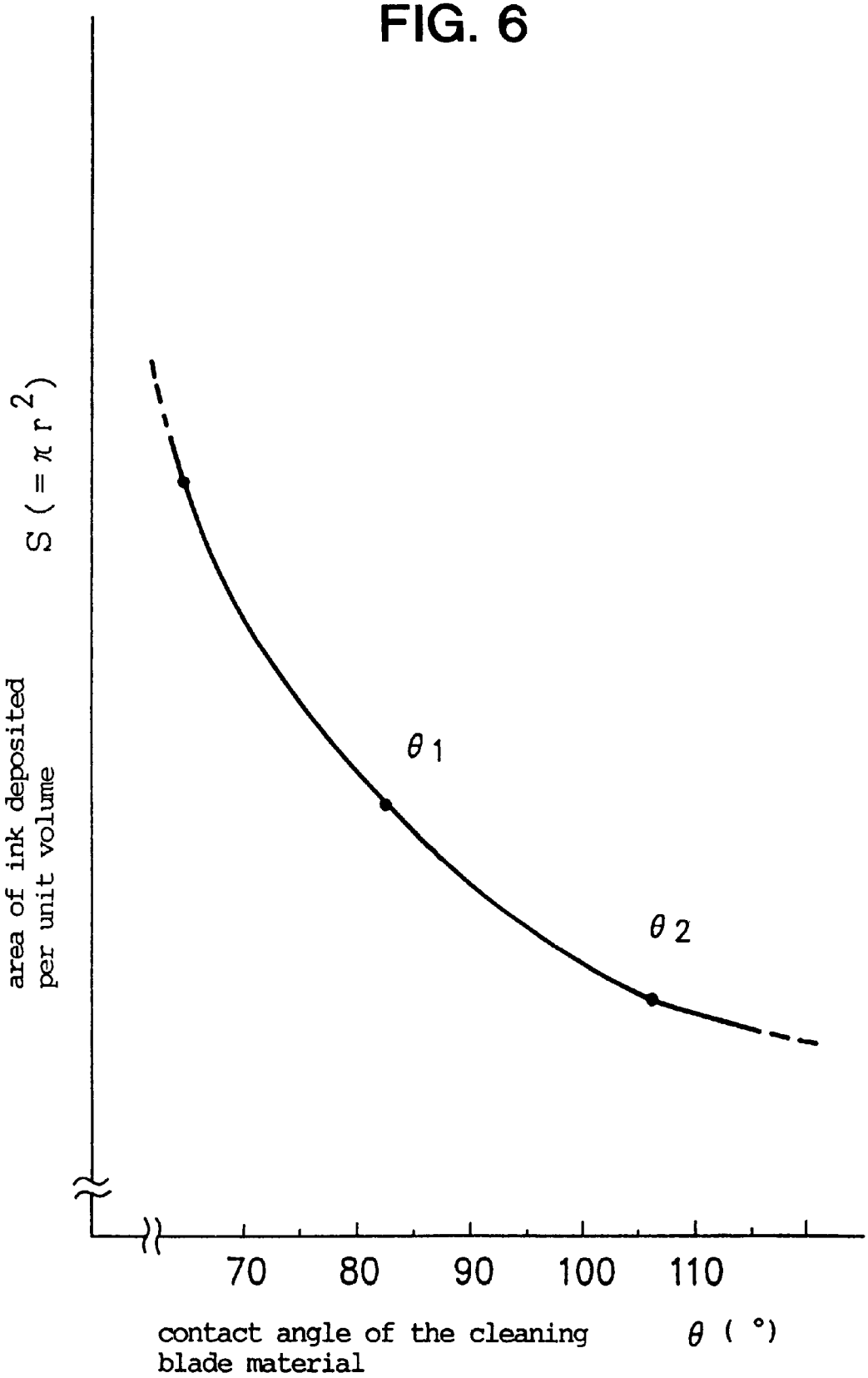
FIG. 6 is a graph illustrating the interrelation between the contact angle of a cleaning blade and the area of ink deposited.
Figure 7A:
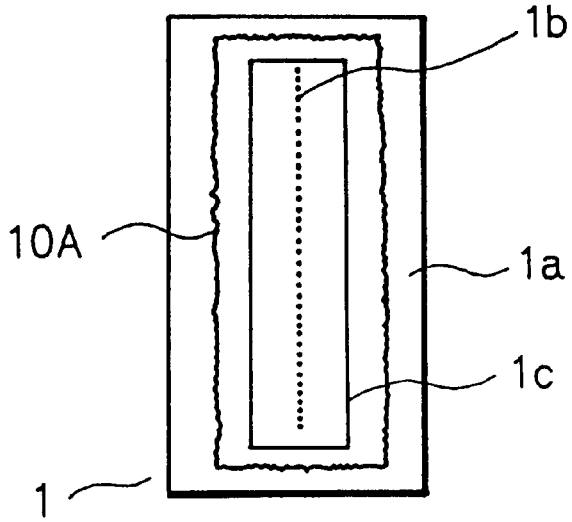
FIGS. 7(*a*) and 7(*b*) are schematic views respectively illustrating the state of a discharging outlet face having foreign matters of ink or the like deposited thereon.
Figure 7B:
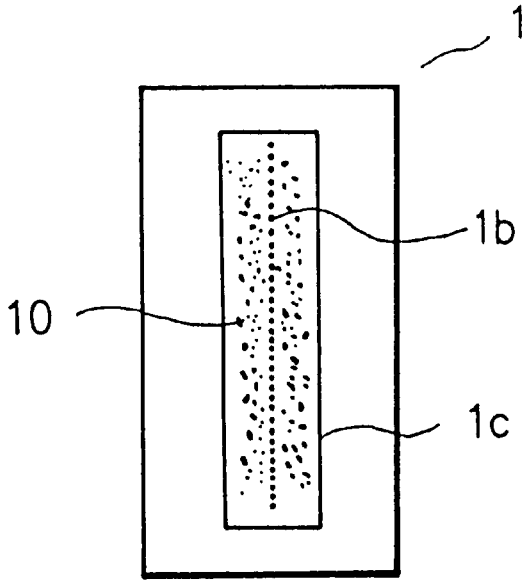
Figure 7C:
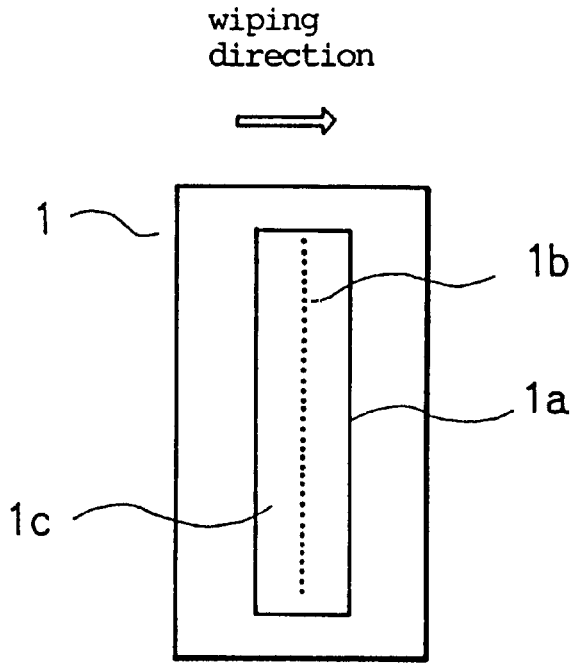
Figure 7D:
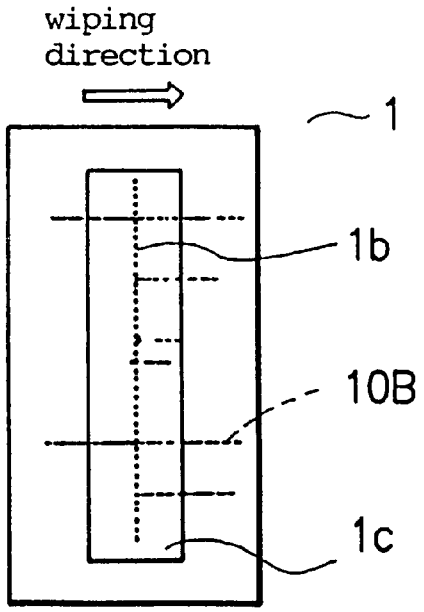

Shown in FIG. 6 is the interrelation between the contact angle of the cleaning blade material and the area of the ink deposited. As apparent from FIG. 6, it is understood that there is a tendency that the smaller the angle θ at which cleaning blade material is contacted, the greater the area of the ink deposited, and the greater the angle θ at which cleaning blade material is contacted, the smaller the area of the ink deposited. Particularly, the angle at which the cleaning blade 4 is contacted with the ink at the position where the cleaning blade is in contact with the discharging outlet is related to the amount of the ink to be pulled out, wherein the lower the water repellency of the cleaning blade, the smaller the foregoing ink contact angle, resulting in increasing the amount of the ink deposited on the cleaning blade, whereby the amount of the ink to be pulled out is increased. Therefore, at the conditions under which ink is liable to deposit on the constituent material of the cleaning blade, the ink once deposited on the cleaning blade at a given position thereof comes to a result that it is taken out from the discharging outlet without being removed along the movement of the cleaning blade during the cleaning operation (see, FIG. 5(*b*)).

The present inventors obtained a finding that the angle at which the cleaning blade is contacted with the ink can be enlarged by imparting relevant water repellency to the cleaning blade and by this, the amount of the ink deposited on the cleaning blade can be diminished, whereby the amount of the ink to be pulled out from the discharging outlet of the ink jet head.

Another object of the present invention is to provide a cleaning blade for ink jet head which comprises an elastic material excelling in abrasion resistance which is added with a desirable water repellency, said cleaning blade being excellent in ink break and being capable of effectively preventing ink from being pulled out from the discharging outlet can be reduced, and the cleaning can be desirably conducted.

SUMMARY OF THE INVENTION

The present invention has been accomplished based on the foregoing results obtained as a result of the studies conducted by the present inventors, and it makes an object to provide an improved cleaning blade for ink jet head which is formed of a material comprising a polyurethane polymer, a bifunctional curing agent and a water repellency-adding material, said cleaning blade being free of occurrence of uneven wear due to chipping and the like even upon continuously conducting recording while conducting cleaning with the use of said cleaning blade wherein a desirable cleaning state can be constantly maintained even upon repeated use of said cleaning blade over a long period of time while preventing ink from being pulled out from the discharging outlet of the ink jet head.

Another object of the present invention is to provide a cleaning blade for ink jet head which comprises an elastic material excelling in abrasion resistance having a desirable water repellency, said cleaning blade being excellent in ink break and being capable of effectively preventing ink from being pulled out from the discharging outlet, and said cleaning blade being capable of being desirably used in an ink jet head capable of providing an excellent recorded image.

A further object of the present invention is to provide an ink jet recording apparatus in which the above cleaning blade is used.

A further object of the present invention is to provide a cleaning member capable of removing foreign matter deposited on the ink discharging outlet face of an ink jet recording head for conducting recording on a record medium by discharging ink, said cleaning member being characterized by comprising an ether series polyurethane rubber elastic body containing a curing component essentially consisting of a bifunctional component.

A further object of the present invention is to provide a cleaning member capable of removing foreign matter deposited on the ink discharging outlet face of an ink jet recording head for conducting recording on a record medium by discharging ink, said cleaning member being characterized by comprising a polyurethane rubber elastic body containing a curing component essentially consisting of a bifunctional component and a water repellency-adding material having an active group reactive with said polyurethane rubber.

A further object of the present invention is to provide an ink jet apparatus comprising a support member capable of supporting an ink jet head for conducting recording on a record medium by discharging aqueous ink, characterized in that said ink jet apparatus comprises means for scanning said support member between a recording zone in which said record medium is transported and a non-recording zone outside said recording zone, said non-recording zone being provided with a cleaning blade capable of cleaning the discharging outlet face of said head, and said cleaning blade comprising an ether series polyurethane rubber elastic body containing a curing component essentially consisting of a bifunctional component.

A further object of the present invention is to provide an ink jet apparatus comprising a support member capable of supporting an ink jet head for conducting recording on a record medium by discharging aqueous ink, characterized in that said ink jet apparatus comprises means for scanning said support member between a recording zone in which said record medium is transported and a non-recording zone outside said recording zone, said non-recording zone being provided with a cleaning blade capable of cleaning the discharging outlet face of said head, and said cleaning blade comprises a polyurethane rubber elastic body containing a curing component essentially consisting of a bifunctional component and a water repellency-adding material having an active group reactive with said polyurethane rubber.

The urethane material which can be desirably used as the main constituent material of the cleaning blade according to the present invention can include urethane materials of ethyleneadipate series, butyleneadipate series, lactone series, polyester series, polycarbonate series, and polyether series. Among these, polyether urethanes are the most desirable particularly in view of the hydrolytic property.

Examples of such polyether urethane are those polyether urethanes obtained by reacting polyoxytetramethylene glycol (hereinafter referred to as PTMET) represented by the general formula $HO(CH_2CH_2CH_2CH_2O)_nH$ with polyisocyanate. Specifically, these can be illustrated commercially available VIBRATHANEs B625, B635, B670, B821, and B836 (trademark names, produced by Uniroyal Chemical Company); and commercially available ADIPIRENEs M400, M415, M467, M483, LW520, and LW570 (trademark names, produced by Du Point Company). Other than these, there can be illustrated other polyether urethanes obtained by reacting polyoxypropylene glycol represented by the general formula $HO(CH_2CH_2CH_2O)_nH$ with polyisocyanate. A specific example is a commercially available VIBRATHANE 843 (trademark name, produced by Uniroyal Chemical Company). It should be understood that these are not limitative.

The above mentioned polyisocyanate is not limitative. Any other isocyanates which are commonly used in the production of polyurethane can be used. Specific examples of such isocyanates are diphenylmethane diisocyanate, tolylene diisocyanate, and hydrogenated diphenylmethane diisocyanate.

The curing agent which serves to make the polyurethane material to provide the foregoing cleaning blade capable of being worn in such a uniformly worn state as above described is required to comprise a bifunctional curing agent. Specific examples of the bifunctional curing agent are 1,4-butanediol, 1,6-hexanediol, ethylene glycol, propylene glycol, polyethylene glycol, hydroquinone ethylol ether, bisphenol A, methylenebisorthodichloroaniline, triethylene glycol p-aminobenzoate, commercially available curing agents VIBRACUREs A120 and A931 (trademark names, produced by Uniroyal Company), and MOCA, and mixtures of two or more of these. Of these curing agents, straight-chain diols are the most desirable in the viewpoints that they are hardly hydrolyzed and are not inhibitive for crystallinity. In the present invention, the use of the bifunctional curing agent does not exclude incorporation of other polyfunctional curing agents as long as their content is in a slight amount as an impurity.

In the viewpoint of improving the initial cleaning property of the cleaning blade, it is possible to use, in addition to the bifunctional curing agent, other polyfunctional curing agents within a prescribed amount (40% or less of the total amount of the curing agents), provided a water repellency-adding material, which will be described herein, is together used.

Specific examples of such polyfunctional curing agents are common urethane-curing agents such as trimethylolpropane, trimethylolethane, and glycerine, and commercially available curing agents VIBRACUREs A125, A510 and A567 (trademarks, produced by Uniroyal Company), and VIBRATHANEs 3080 and 3095 (trademark names, produced by Uniroyal Company), and mixtures of two or more of these.

As the water repellency-adding material serving to improve the cleaning blade such that it does not take up ink in the present invention, those which do not bleed to reduce the water repellency of the cleaning blade even upon repeated use over a long period of time are desirably used. Desirable examples are water repellency-adding materials having at least an active group reactive with the foregoing polyurethane material such as hydroxyl group, amino group, epoxy group, isocyanate group, and the like in one molecule. And it is desired for these water repellency-adding materials to contain a chemical structure having low surface energy in their molecule, from the viewpoint that the cleaning blade is required to maintain its water repellency even in the case where it is in a swelled state as a result of having absorbed ink.

Such water repellency-adding material can include modified silicone compounds and reactive fluorine-containing compounds. Commercially available examples of the reactive fluorine-containing compounds are MF 100, MF110, MF 120, and MF130 (produced by Mitsubishi Material Corporation); Cm Alcohol and HFIP (produced by Central Glass Co., Ltd.); and PFA6 (produced by NEOS Company Ltd.).

Commercially available examples of the modified silicone compounds are amino-modified silicones SF8417, and BY16-828 (produced by Toray Dow Corning Silicone Co., Ltd.); epoxy-modified silicone SF8411 (produced by Toray Dow Corning Silicone Co., Ltd.); and alcohol-modified silicones BX16-005, SF8427 and SF8428 (produced by Toray Dow Corning Silicone Co., Ltd.), X-22-160AS (produced by, Shinetsu Silicone Company), and DKDKQ8-779 (produced by Dow Corning Company). It should be understood that these are not limitative.

Now, when a water repellency-adding material which is slightly soluble in the foregoing polyurethane rubber material is used, it becomes present in particle state in the polyurethane rubber material. In the case where such water repellency-adding material is present in particle state in the polyurethane rubber material, the effect of adding a water repellency to the polyurethane rubber material is not sufficient. In order to avoid occurrence of this problem, it is necessary to add an excessive amount of such water repellency-adding material. However, in this case, the physical properties of the polyurethane rubber material are more or less deteriorated. In addition, the presence of particle components of such water repellency-adding material often becomes a cause of providing uneven wear at the cleaning blade during the cleaning operation, and therefore, such cleaning blade is not suitable for long time use. In view of this, it is desired for the water repellency-adding material to be present in a state of being compatible with the polyurethane rubber material.

Further, in the case of using the cleaning blade in an ink jet system in which recording is conducted by discharging ink droplets by means of a discharging element, the use of a modified silicone compound is not desirable in the viewpoint that there is a fear that foreign matter from the compound is seized at the heat generating body.

Taking account of the solubility of the polyurethane rubber material and a fear of the occurrence of seizing foreign matter to the heat generating body, the foregoing reactive fluorine-containing compounds are the most desirable.

In the present invention, the ink contact angle for the cleaning blade is desired to be 80° or above. It should be understood that the ink contact angle in any of the cases which satisfy the under-described definite amounts of the respective components is within the above range.

As a most preferred embodiment of the constituent material of the cleaning blade according to the present invention, there can be mentioned materials comprising a polyurethane material as the main component, a curing agent essentially consisting of a bifunctional component and a water repellency-adding material.

The cleaning blade formed of such a specific material is markedly advantageous in that a uniformly worn state peculiar for the cleaning blade is provided because of using the bifunctional curing agent during the cleaning operation, and a desired contact angle is maintained between the cleaning blade and the ink because of using the water repellency-adding material, wherein the amount of the ink to be pulled out from the discharging outlet during the cleaning operation is markedly diminished, and the blade cleaning operation can be conducted with a constant and uniform pressure without causing any ink escape.

The amount of each of the bifunctional curing agent and the water repellency-adding material to be incorporated is desired to be made such that the sum of the molarity of the active element of the bifunctional curing agent and that of the water repellency-adding material is preferably in the range of from 0.80 to 1.05, more preferably in the range of from 0.90 to 1.00, versus the molarity of the isocyanate group contained in the polyurethane material as the main component of the cleaning blade.

Particularly, as for the amount of the water repellency-adding material, it is desired to be preferably in the range of from 0.1 to 20 parts by weight, more preferably in the range of from 1 to 10 parts by weight, versus 100 parts by weight of the sum of the polyurethane material and the bifunctional curing agent. In the case where the use amount of the water repellency-adding material is less than 0.1 part by weight, a sufficient water repellency is not provided, resulting in causing the foregoing ink pull-out and color admixture. In the case where the use amount of the water repellency-adding material is exceeding 20 parts by weight, the rubber physical properties are remarkably deteriorated, wherein there is a fear that marked wear is caused at the cleaning blade upon repeated use over a long period of time.

In a preferred embodiment of the present invention, there are included a cleaning blade member obtained by using the polyurethane material and the bifunctional curing agent and a cleaning blade member obtained by using the polyurethane material as the main starting material, the bifunctional curing agent, a polyfunctional curing agent (in a slight amount), and the water repellency-adding material. Herein, the use of the bifunctional curing agent only does not exclude such a case that a polyfunctional curing agent in an amount in terms of an impurity is contained. The amount of the bifunctional curing agent to be incorporated and that of the water repellency-adding material in each of said two cleaning blade members are adjusted to satisfy the definite range described in the foregoing most preferred embodiment.

The cleaning blade member according to the present invention can be prepared in a manner that a given amount of the polyurethane material in molten state, a given amount of the bifunctional curing agent in molten state, and if necessary, a given amount of the water repellency-adding material having been heated, are mixed while stirring to obtain a mixture, if necessary followed by degassing, the resultant mixture is introduced into a die or a centrifugal making machine, wherein the mixture is subjected to heat curing treatment at a temperature of 80° to 140° C. It is possible that the water repellency-adding material is firstly mixed with the polyurethane material to chemically react with each other and thereafter, the curing agent is added thereto. Further, it is possible that the water repellency-adding material is firstly resolved in or dispersed into the curing agent, and the resultant is subjected to chemical reaction with the polyurethane material.

In the cleaning blade member thus prepared, the water repellency-adding material is contained in the inside of the polyurethane rubber resulted, and because of this, the cleaning blade member always maintain a desirable water repellency without being reduced even when its surface is worn upon rubbing. The hardness of the constituent rubber material of the cleaning blade member should be properly determined depending upon the cleaning property of the ink used. However, in general, it is desired to be preferably in the range of from 40° to 90°, more preferably in the range of from 50° to 90° in terms of JISA Hardness.

EXPERIMENTS

In the following, description will be made of the experiments conducted by the present inventors.

Experiment A 22.7 parts by weight of heat-molten polyethylene glycol (as the bifunctional curing agent, molecular weight:1000) was mixed with 5.7 parts by weight of 1,4-butanediol (as the bifunctional curing agent) to obtain a mixture. To the mixture, 3.6 parts by weight of N-n-propyl-N-2,3-dihydroxypropylper-fluorooctylsulfoneamide (as the fluorine-containing water repellency-adding material, trademark name:FM 110, produced by Mitsubishi Materials Corporation) was added while stirring at 90° C., to thereby obtain a homogenous solution.

The resultant solution was mixed with 100 parts by weight of polyurethane polymer (ether series PTMEG-MD 1, NOCO content:7.7 wt. %, trademark name.: VIBRATHANE B635, produced by Uniroyal Chemical Company) maintained at 80° C. while stirring to obtain a mixture wherein the molarity of each of the active element of the curing agent and that of the water repellency-adding material versus the molarity of the isocyanate group of the polyurethane polymer (hereinafter referred to as OH/NCO) was adjusted to be 1.00. The resultant mixture was subjected to degassing treatment under vacuum condition, to thereby obtain a homogenous liquid mixture.

The liquid mixture obtained was introduced into a centrifugal making machine maintained at 130° C., wherein the liquid mixture was subjected to curing treatment for an hour. The resultant was taken out from the making machine, followed by subjecting to secondary curing treatment at 130° C. for 4 hours, whereby 0.7 mm thick transparent sheet member containing the water repellency-adding material in an amount of 3 parts by weight versus 100 parts by weight of the total amount of the polyurethane and the curing agent.

The resultant sheet was subjected to edge-cutting, followed by die cutting into a size of 10 mm×15 mm, to thereby obtain a cleaning blade sample A for test. This blade sample was saved for evaluation with respect to various evaluation items which will be later described.

Experiment B

The procedures of Experiment A were repeated, except that the amount of each of the polyethylene glycol, 1,4-butanediol, and N-n-propyl-N-2,3-dihydroxypropylper-fluorooctylsulfoneamide was changed to 23.6 parts by weight, 5.9 parts by weight, and 1.3 parts by weight, respectively, to thereby obtain a transparent sheet in which the amount of the water repellency-adding material was adjusted to be about 1 part by weight. The sheet was subjected to die cutting under the same condition as in Experiment A, whereby a cleaning blade sample B for test was obtained.

Experiment C

The procedures of Experiment A were repeated, except that the amount of each of the polyethylene glycol, 1,4-butanediol, and N-n-propyl-N-2,3-dihydroxypropylper-fluorooctylsulfoneamide was changed to 21.6 parts by weight, 5.4 parts by weight, and 6.3 parts by weight, respectively, to thereby obtain a transparent sheet in which the amount of the water repellency-adding material was adjusted to be about 5 parts by weight. The sheet was subjected to die cutting under the same condition as in Experiment A, whereby a cleaning blade sample C for test was obtained.

Experiment D

The procedure of Experiment A were repeated, except that the amount of each of the polyethylene glycol, 1,4-butanediol, and N-n-propyl-N-2,3-dihydroxypropylper-fluorooctylsulfoneamide was changed to 24.0 parts by weight, 6.0 parts by weight,.and 0.2 part by weight, respectively, to thereby obtain a transparent sheet in which the amount of the water repellency-adding material was adjusted to be about 0.2 part by weight. The sheet was subjected to die cutting under the same condition as in Experiment A, whereby a cleaning blade sample D for test was obtained.

Experiment E

The procedures of Experiment A were repeated, except that the amount of each of the polyethylene glycol, 1,4-butanediol, and N-n-propyl-N-2,3-dihydroxypropylper-fluorooctylsulfoneamide was changed to 18.6 parts by weight, 4.7 parts by weight, and 13.4 parts by weight, respectively, to thereby obtain a transparent sheet in which the amount of the water repellency-adding material was adjusted to be about 10 parts by weight. The sheet was subjected to die cutting under the same condition as in Experiment A, whereby a cleaning blade sample E for test was obtained.

Experiment F

The procedures of Experiment A were repeated, except that the amount of each of the polyethylene glycol 1,4-butanediol, and N-n-propyl-N2,3-dihydroxypropylperfluor-ooctylsulfoneamide was changed to 14.1 parts by weight, 3.5 parts by weight, and 23.5 parts by weight, respectively, to thereby obtain a transparent sheet in which the amount of the water repellency-adding material was adjusted to be about 20 parts by weight. The sheet was subjected to die cutting under the same condition as in Experiment A, whereby a cleaning blade sample F for test was obtained.

Experiment G

The procedures of Experiment A were repeated, except that the amount of each of the polyethylene glycol, 1,4-butanediol, and N-n-propyl-N2,3-dihydroxypropylperfluorooctylsulfoneamide was changed to 19.3 parts by weight, 4.8 parts by weight, and 3.2 parts by weight, respectively, wherein the OH/NOC was adjusted to be 0.8, to thereby obtain a cleaning blade sample G for test.

Experiment H

The procedures of Experiment A were repeated, except that the amount of each of the polyethylene glycol, 1,4-butanediol, and N-n-propyl-N2,3-dihydroxypropylperfluorooctylsulfoneamide was changed to 23.8 parts by weight, 6.0 parts by weight, and 3.8 parts by weight, respectively, wherein the OH/NOC was adjusted to be 1.05, to thereby obtain a cleaning blade sample H for test.

Experiment I

The procedures of Experiment A were repeated, except that the water repellency-adding material was changed to 3-(2-perfluorohexyl) ethoxy-1,2 dihyroxypropane (as the fluorine-containing water repellency-adding material, trademark name:MF100, produced by Mitsubishi Materials Corporation) of 3.6 parts by weight, to thereby obtain a cleaning blade sample I for test.

Experiment J

The procedures of Experiment A were repeated, except that the water repellency-adding material was changed to $C_9F_{17}O—(CH_2)_6—OH$ (as the fluorine-containing water repellency-adding material, trademark name:PFA6, produced by NEOS Company Ltd.) of 3.6 parts by weight, to thereby obtain a cleaning blade sample J for test.

Experiment K

The procedures of Experiment A were repeated, except that the water repellency-adding material was changed to alcohol-modified silicone oil (as the silicone series water repellency-adding material, trademark name: SF8427 produced by Toray Dow Corning Silicone Co., Ltd.) of 3.8 parts by weight, to thereby obtain a cleaning blade sample K for test.

Experiment L

The procedures of Experiment A were repeated, except that the amount of each of the polyethylene glycol and 1,4-butanediol was changed to 24.3 parts by weight and 6.1 parts by weight, respectively, and no water repellency-adding material was used, to thereby obtain a cleaning blade sample L for test.

Experiment M

The procedures of Experiment A were repeated, except that as the bifunctional curing agent, 69.8 parts weight of polyethylene glycol was solely used, and the amount of the N-n-propyl-N2,3-dihydroxypropylperfluorooctylsulfoneamide was changed to 3.9 parts by weight, to thereby obtain a cleaning blade sample M for test.

Experiment N

The procedures of Experiment A were repeated, except that as the bifunctional curing agent, 34.0 parts. weight of polyethylene glycol was solely used, and the amount of the N-n-propyl-N2,3-dihydroxypropylperfluorooctylsulfoneamide was changed to 3.3 parts by weight, to thereby obtain a cleaning blade sample N for test.

Experiment O

The procedures of Experiment A were repeated, except that the polyurethane polymer was replaced by ether series PPG-MD 1 (trademark name: VIBRATHANE B-843, produced by Uniroyal Chemical Company) of 100 parts by weight, as the bifunctional curing agent, 2.3 parts by weight of ethylene glycol and 9.3 parts by weight of 1,6-hexanediol were used, and the amount of the N-n-propyl-N-2,3-dihydroxypropylperfluorooctylsul-foneamide was changed to 2.9 parts by weight, to thereby obtain a cleaning blade sample O for test.

Experiment P

The procedures of Experiment A were repeated, except that the polyurethane polymer was replaced by ether series PTMEG-HMD 1 (trademark name: ADIPRENE LW520, produced by Uniroyal Chemical Company) of 100 parts by weight, and the amount of the N-n-propyl-N2,3-dihydroxypropylperfluorooctylsulfoneamide was changed to 3.5 parts by weight, to thereby obtain a cleaning blade sample P for test.

Experiment Q

The procedures of Experiment A were repeated, except that the polyurethane polymer was replaced by ester series EA-MD 1 (trademark name: CORONATE C4369, produced by Japan Polyurethane Company) of 100 parts by weight, as the bifunctional curing agent, 1.5 parts by weight of 1,4-butanediol and 5.9 parts by weight of 1,6-hexanediol were used, and as the water repellency-adding material, 3.2 parts by weight of MF100 (trademark name, produced by Mitsubishi Materials Corporation) was used, to thereby obtain a cleaning blade sample Q for test.

Experiment R

The procedures of Experiment A were repeated, except that the polyurethane polymer was replaced by ester series EA-MD 1 of 100 parts by weight, as the bifunctional curing agent, 1.6 parts by weight of 1,4-butanediol and 6.5 parts by weight of 1,6-hexanediol were used, and no water repellency-adding material was used, to thereby obtain a cleaning blade sample R for test.

Experiment S

The procedures of Experiment A were repeated, except that the polyurethane polymer was replaced by ester series EA-MD 1 of 100 parts by weight, as the bifunctional curing agent, 4.0 parts by weight of 1,4-butanediol was solely used, 1.0 part by weight of trimethylolpropane (trifunctional curing agent) was used as the polyfunctional curing agent, and as the water repellency-adding material, 3.1 parts by weight of MF100 was used, to thereby obtain a cleaning blade sample S for test.

Experiment T

The procedures of Experiment A were repeated, except that as the bifunctional curing agent, 5.8 parts by weight of 1,4-butanediol was solely used, 1.4 parts by weight of trimethylolpropane was used as the polyfunctional curing agent, and no water. repellency-adding material was used, to thereby obtain a cleaning blade sample T for test.

Experiment U

The procedures of Experiment A were repeated, except that the polyurethane polymer was replaced by ester series EA-MD 1 of 100 parts by weight, as the bifunctional curing agent, 4.8 parts by weight of 1,4-butanediol was solely used, 1.2 part by weight of trimethylolpropane was used as the polyfunctional curing agent, and no water repellency-adding material was used, to thereby obtain a cleaning blade sample U for test.

Experiment V

The procedures of Experiment A were repeated, except that hydrogenated nitrile rubber of G-655 (trademark name, produced by Japan Oil Seal Company), to thereby obtain a 0.7 mm thick sheet, which was followed by die cutting, whereby a cleaning blade sample V for test was obtained.

Experiment W 100 parts by weight of silicone rubber SH861U (trademark name, produced by Toray Dow Corning Silicone Co., Ltd.) was mixed with 2 parts by weight of a curing agent RC4 (trademark name, produced by Toray Dow Corning Silicone Co., Ltd.) to obtain a mixture, which was followed by subjecting press molding using a die, to obtain a 0.7 mm thick sheet. The resultant was subjected to die cutting in the same manner as in Experiment A, to thereby obtain a cleaning blade sample W for test.

Figure 8:
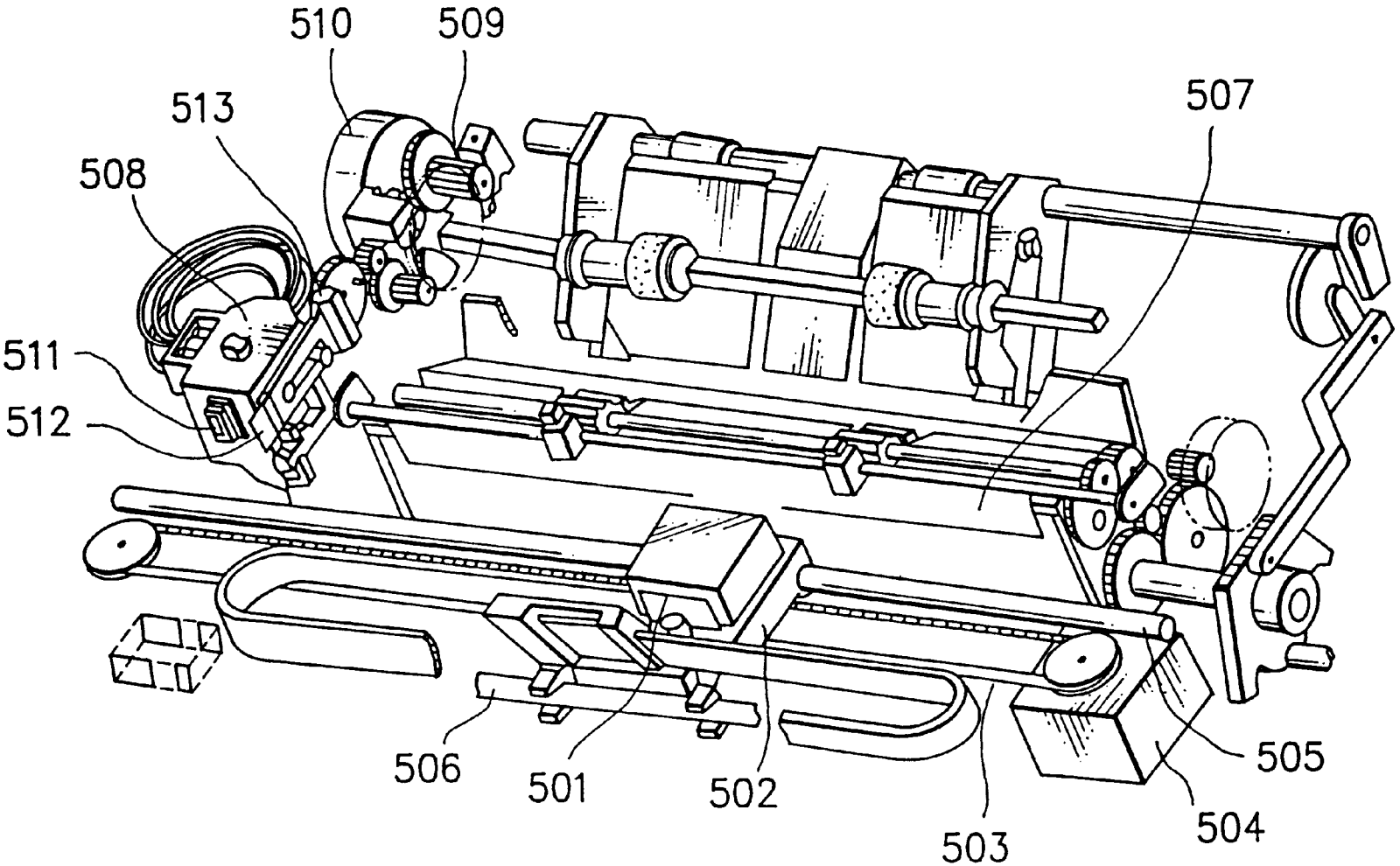
FIG. 8 is a schematic slant view illustrating the principal part of an embodiment of an ink jet recording head apparatus provided with a cleaning blade according to the present invention.
Figure 9A:
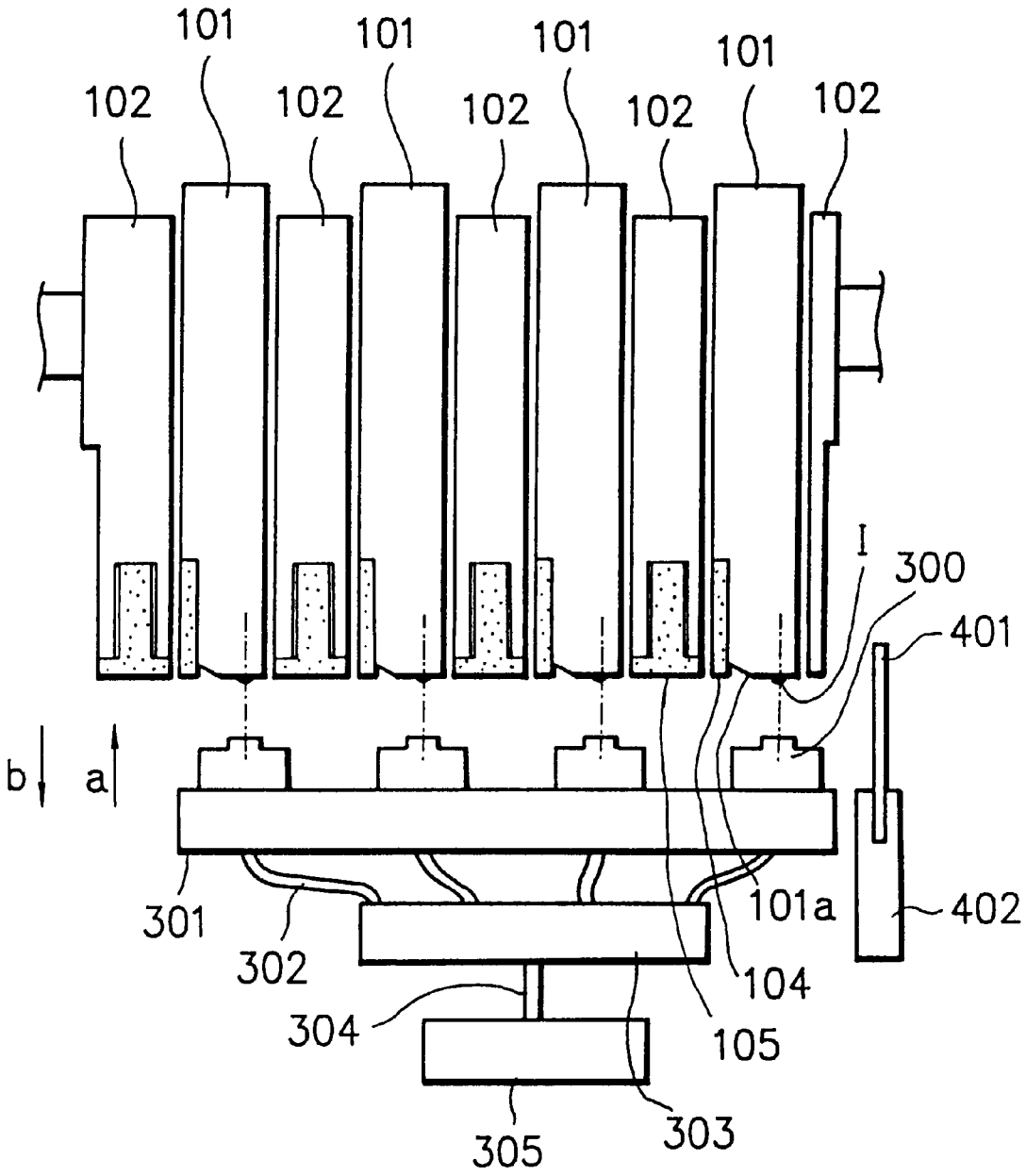
FIGS. 9(*a*) through 9(*d*) are schematic views step-wise explaining the cleaning operation by a cleaning blade in an ink jet recording apparatus for practicing color recording in the present invention.
Figure 9B:
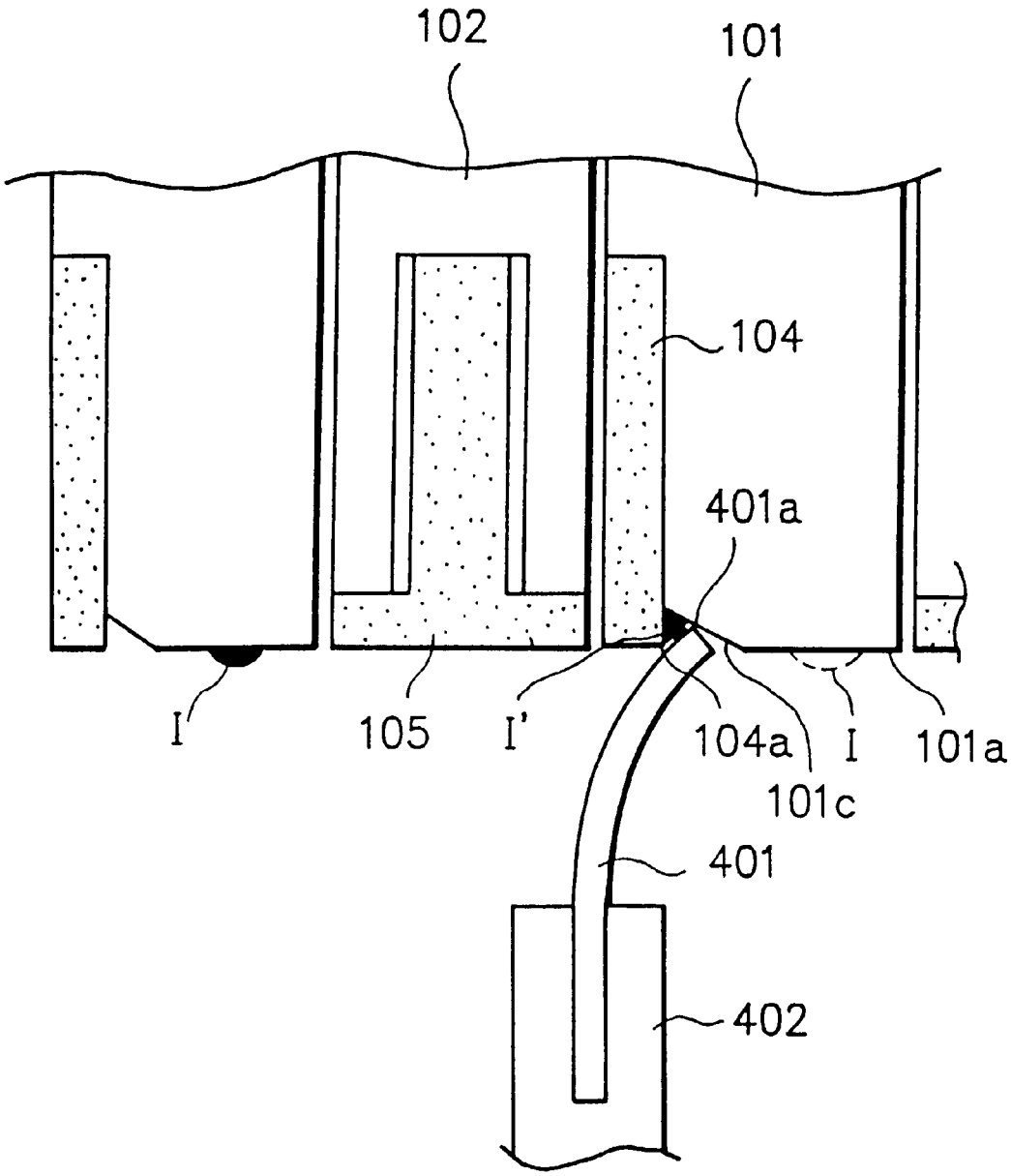
Figure 9C:
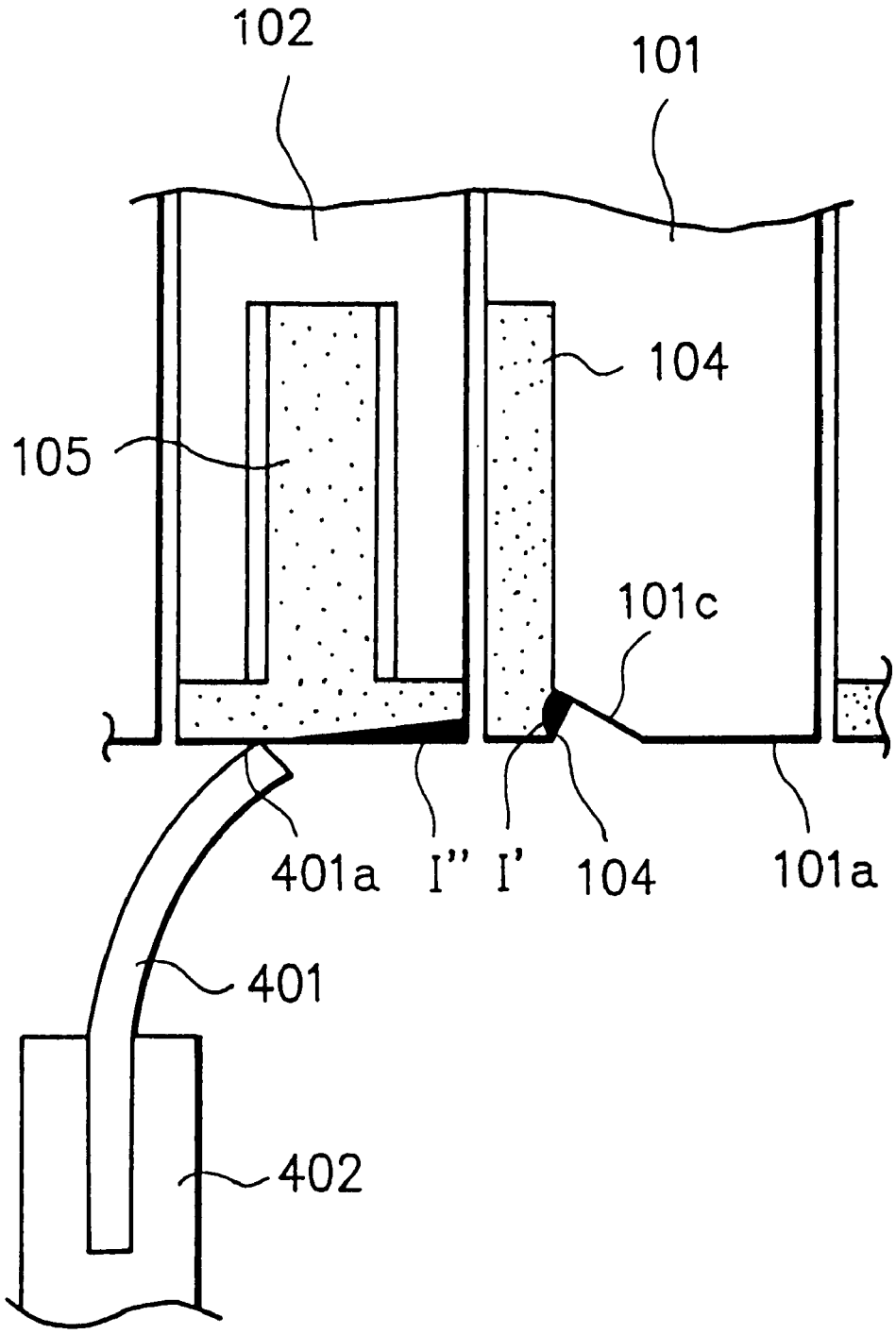
Figure 9D:
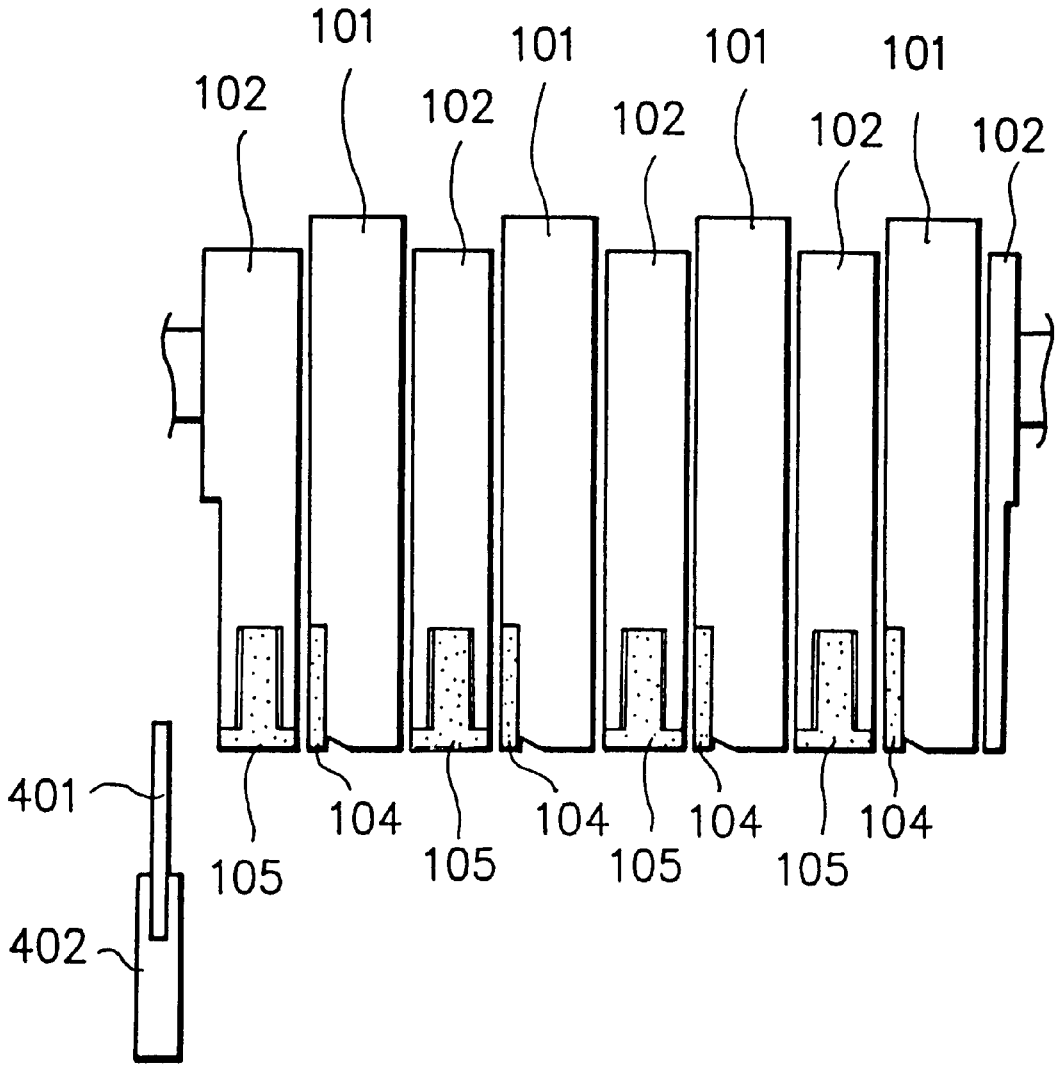
Figure 10A:
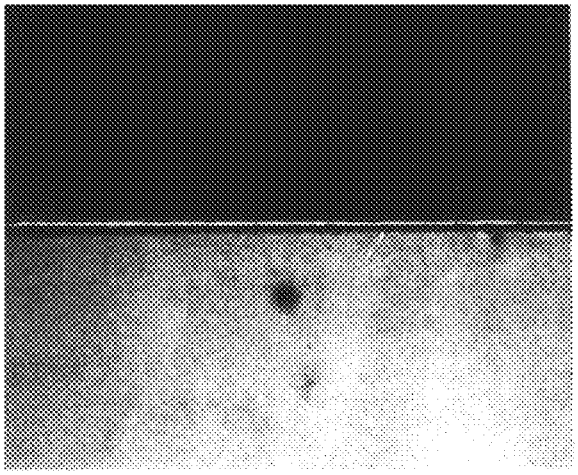
FIG. 10 contains photographs respectively showing the states of a cleaning blade according to the present invention after having been repeatedly used in the cleaning operation, and states of a cleaning blade not belonging to the present invention after having been repeatedly used in the cleaning operation.
Figure 10B:
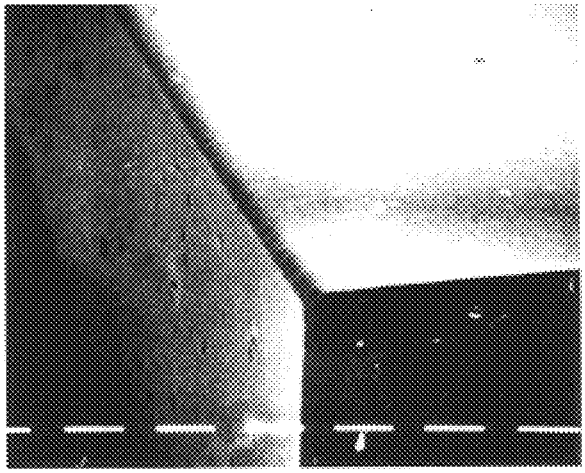
Figure 10C:
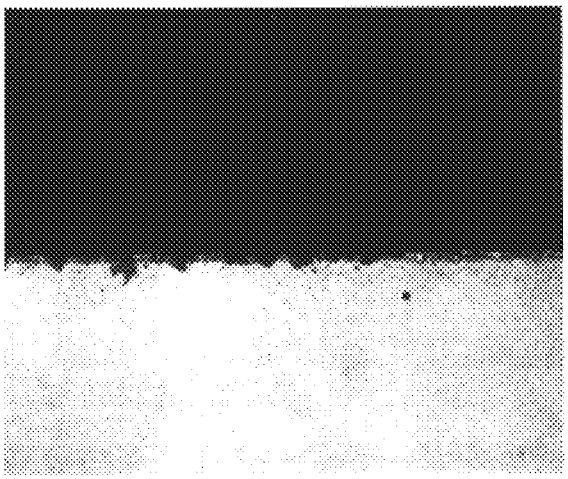
Figure 10D:
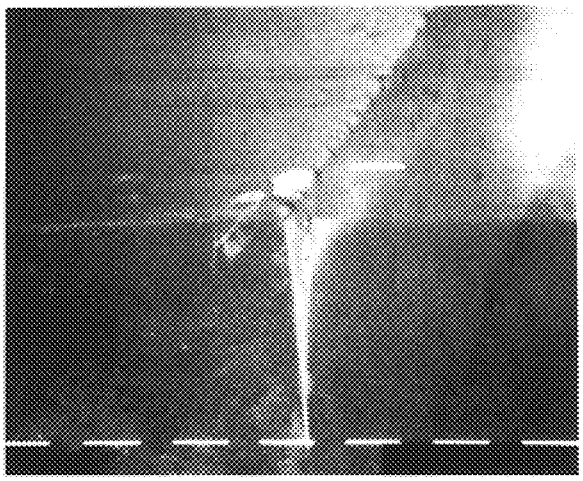

As for each of the cleaning blade samples A to W obtained in Experiments A to W, evaluation was made with respect to surface roughening situation, abrasion resistance, head damaging resistance, ink pulling-out property, and the quality of a recorded image obtained using an ink recording apparatus of the constitution shown in FIG. 8.

Herein, explanation will be made of the ink jet recording apparatus used for conducting the above evaluation.

FIG. 8 is a schematic slant view illustrating the principal part of an embodiment of an ink jet recording apparatus which is provided with one of the foregoing cleaning blade member samples.

In the figure, reference numeral 501 indicates a detachable cartridge type ink jet recording head which is provided with a plurality of ink discharging qutlets opposite the recording face of a recording sheet transported on a platen 507. Numeral reference 502 indicates a carriage (HC) for holding the IJC 501 thereon. The carriage is part of a driving belt 504 which serves to transmit a driving force from a driving motor 503, and it is designed such that it can be moved while sliding on a pair of guide shafts 505 and 506 with each other. By this, the ink jet recording head is made capable of moving back and forth along the entire width of the recording sheet.

Numeral reference 508 indicates a recovery device which is disposed at a given position within the range in which the IJC 501 is moved, specifically, for example, at a position opposite the home position. The recover device 508 performs capping to the discharging outlets of the IJC 501 by driving force through a driving mechanism 509 from a motor 510. In connection with the capping performance to the discharging outlets of the IJC 501 by means of a cap 511 of the recover device 508, there is performed suction of ink from the discharging outlets by means of an appropriate aspirator (not shown) installed in the recover device 508 or force feed of ink by means of appropriate pressure means (not shown) mounted to the ink supply path of the IJC 501. By this, ink is forced to discharge through the discharging outlets to thereby conduct recovery treatment including removal of foreign matter such as viscid ink material present in the inside of each of the discharging outlets. And by conducting capping to the discharging outlets upon completing the recording, the recording head can be protected.

Numeral reference 512 indicates a cleaning blade according to the present invention which is disposed at a side face of the head recovery device 508. The cleaning blade 512 is held at a blade holding member 513 in the form of a cantilever boom, and it is operated, as well as in the case of the recovery device 508, by means of the motor 510 and the driving mechanism 509 so as to encounter the discharging outlet face of the IJC 501. By this, the cleaning blade 512 is projected in the range in which the IJC 501 is moved on appropriate timing during the recording operation by the IJC 501 or after recovery treatment by using the recovery device 508, whereby dew drops, moisture, dusts or the like deposited on the discharging outlet face of the IJC can be swabbed.

Independently, as for each of the cleaning blade member samples, evaluation was conducted with respect to rubber hardness under the JISA, existence state of the water repellency-adding material, ink contact angle, and ink modification. In the following, description will be made of the manner of evaluation of each of the evaluation items.

(1) Evaluation of the Rubber Hardness:

The measurement of the rubber hardness was conducted in accordance with the rubber hardness measuring method described in the JIS (Japan Industry Standard) A. The measured results obtained are shown in Table 1.

(2) Evaluation of the Existence State of the Water Repellency-adding Material:

The cross sectional face of the cleaning blade member sample which resulted when the sheet member was cut was observed by eyes using a microscope.

The observed results are shown in Table 1, in which the sample for which the existence of particles of the water repellency-adding material was observed is shown by the term "particle", and the sample for which the existence of particles of the water repellenty-adding material was not observed is shown by the term "compatible".

(3) Evaluation of the Ink Contact Angle:

As for each of the cleaning blade member samples A to W, the ink contact angle was measured by means of a contact angle meter (trademark name: A-Z150, produced by Kyowa Kaimenkagaku Kabushiki Kaisha), wherein aqueous ink composed of 23 wt. % of C.I. Food Black, 25 wt. % of diethylene glycol, 20 wt. % of N-methyl-2-pyrrolidone, and 52 wt. % of water (this ink will be hereinafter referred to as use ink) was used. The measured results obtained are shown in Table 1. In Table 1, the measured result shown in the column "initial stage" is of the ink contact angle measured for the cleaning blade sample prior to practical use in the cleaning operation. Similarly, the measured result shown in the column "after ink swelled" is of the ink contact angle measured after the cleaning blade sample has been immersed in the use ink for 10 days.

(4) Evaluation of the Ink Modification:

Each cleaning blade sample was immersed in the use ink for 3 months, and the ink used therein was subjected to compositional analysis using a gas chromatograph (trademark name: GC-9A, produced by Shimadzu Seisakusho Ltd.). The analyzed ink composition was compared with the composition of the use ink before use. The observed results are shown in Table 1, in which the case wherein no modified state was observed is indicated by the mark ⊙, the case wherein modified state was substantially not observed is indicated by the mark o, the case wherein a change was observed in the composition but said change is considered not to negatively influence an image recorded is indicated by the mark Δ, and the case wherein a significant change was observed in the composition and said change is considered to negatively influence an image recorded is indicated by the mark X.

(5) Evaluation of the Surface Roughening Situation and Abrasion Resistance:

Each cleaning blade sample was set to the ink jet recording apparatus shown in FIG. 8 so as to satisfy the conditions of 8 mm as for the free length of the blade member and 1.5 mm as for the entrance extent into the head. 50 non-ink discharging shots were conducted against the cap. Then, the cycle in which the sequence of conducting one cleaning operation is repeated ten times and thereafter, a given pattern is recorded on a recording sheet was repeated until the frequency of the cleaning operation became 50,000 times, wherein the cleaning operation was conducted at a cleaning speed of 150 mm/sec. and the linear pressure of the cleaning blade member to the discharging outlet face was made to be 5 g/cm. The cleaning blade sample by which 50,000 times cleaning operations had been conducted was observed by eyes using a microscope.

The evaluation of the surface roughening situation was conducted on the basis of the following criteria: ⊙ the mark for the case wherein the surface of the cleaning blade sample is not roughened and has no partially worn portion at the edge portion; the mark o for the case wherein the surface of the cleaning blade sample is not roughened, slightly worn portions are found at the edge portion, but such slightly worn portions are not problematic upon conducting the cleaning operation; the mark Δ for the case wherein the surface of the cleaning blade sample is roughened, distinguishable worn portions are found at the edge portion, and these defects are likely to slightly influence for the cleaning operation; and the mark X for the case wherein the surface of the cleaning blade sample is roughened, remarkably worn portions are found at the edge portion, and these defects significantly influence the cleaning operation. The evaluated results are shown in Table 1.

The evaluation of the abrasion resistance was conducted on the basis of the following criteria: the mark ⊙ for the case wherein wear is not found at the edge portion of the cleaning blade sample; the mark o for the case wherein a slight wear is found at the edge portion of the cleaning blade sample, but such slight wear is not problematic for the cleaning operation; the mark Δ for the case wherein a distinguishable wear is found at the edge portion of the cleaning blade sample, and the wear is likely to influence the cleaning operation; and the mark X for the case wherein remarkably worn portions are found at the edge portion of the cleaning blade sample, and such worn portion significantly influences for the cleaning operation. The evaluated results are shown in Table 1.

(6) Evaluation of the Head Damaging Resistance and Ink Pulling-out Property:

As for each of the cleaning blade samples, after the cleaning operation was repeated 50,000 times under the same conditions as in the above evaluation, the peripheries of the discharging outlets of the discharging outlet face of the recording head were observed by eyes using a microscope.

The evaluation of the head damaging resistance was conducted on the basis of the following criteria: the mark ⊙ for the case wherein no damage is found at the discharging outlet face of the recording head; the mark o for the case wherein there is found a slight damage at the discharging outlet face of the recording head, which is however substantially not problematic for the discharging performance; the mark Δ for the case wherein a few damages are found at the discharging outlet face of the recording head, which are likely to influence the discharging performance; and the mark X for the case wherein remarkable damages are found at the discharging outlet face of the recording head, which greatly influence for the discharging performance. The evaluated results are shown in Table 1.

The evaluation of the ink pulling-out property was conducted on the basis of the following criteria: the mark ⊙ for the case wherein no ink is pulled out; the mark o for the case wherein ink is substantially not pulled out; the mark Δ for the case wherein a slight amount of ink is pulled out, but such ink pull-out is likely to slightly influence the discharging performance; and the mark X for the case wherein a significant amount of ink is pulled out, and such significant ink pull-out greatly influences the discharging performance. The evaluated results are shown in Table 1.

(7) Evaluation of the Quality of an Image Recorded:

Each cleaning blade sample was set to the ink jet recording apparatus shown in FIG. 8 so as to satisfy the conditions of 8 mm as for the free length of the blade member and 1.5 mm as for the entrance extent into the head. 50 non-ink discharging shots were conducted against the cap. The, the sequence of conducting one cleaning operation was repeated ten times, and thereafter, a given patter was recorded on a recording sheet. This cycle was repeated until the frequency of the cleaning operation became 10,000 times, 50,000 times, and 100,000 times, these three cases, the recorded state of the recording pattern was evaluated by eyes.

In the above, the cleaning operation was conducted at a cleaning speed of 150 mm/sec., and the linear pressure of the cleaning blade member to the discharging outlet face was made to be 5 g/cm.

The evaluation of the quality of an image recorded was conducted on the basis of the following criteria: the mark ⊙ for the case wherein excellent recorded images are provided; the mark o for the case wherein practically acceptable good recorded images are provided; the mark Δ for the case wherein a recorded image accompanied by defects due to non-discharging is found as for one or two of 1000 recording sheets; and.the mark X for the case wherein a-recorded image accompanied by defects due to non-discharging is found almost in every recording. The evaluated results are shown in Table 1.

From the results shown in Table 1, the following facts have been recognized. That is, (i) any of the cleaning blade samples prepared by using polyurethane prepolymer, a curing agent essentially consisting of a bifuctional component, and in addition, a water repellency-adding material is satisfactory with respect to each of the foregoing evaluation items; (ii) of these cleaning blade samples, the cleaning blade samples prepared in the manner that the ratio (OH/NCO) of the molarity of the active element of each of the bifunctional curing agent and water repellency-adding material versus the molarity of the isocyanate group contained in the polyurethane prepolymer is adjusted to be preferably in the range of from 0.80 to 1.05, more preferably in the range from 0.9 to 1.0 provide a good result with respect to each of the foregoing evaluation items; (iii) especially, the cleaning blade samples prepared in the manner that the water repellency-adding material is added in an amount preferably in the range of from 0.1 to 20 parts by weight, more preferably in the range of from 1 to 10 parts by weight versus 100 parts by weight of the total amount of the polyurethane prepolymer and the bifunctional curing agent provide a markedly excellent result with respect to each of the foregoing evaluation items.

In addition to the above facts, it has been also found that the state of the water repellency-adding material to be contained in the constituent material of the cleaning blade in the compatible state is an extremely important factor in order for the cleaning blade to exhibit and maintain a desirable cleaning function.

TABLE 1

| | | Experiment | | | | | | | |
|---|---|---|---|---|---|---|---|---|---|
| | | A | B | C | D | E | F | G | H |
| polyurethane prepolymer | PTMEG-MD1 NCO content | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % | 100 NCO 7.7 wt % |
| | PPG-MD1 NCO cont. 10.0 wt% | | | | | | | | |
| | PTMEG-HMD1 NCO cont. 7.5 wt % | | | | | | | | |
| | EA-MD1 osteurethane NCO cont. 6.2 wt % | | | | | | | | |
| curing agent | polyethylene glycol molecular weight 100 bifunctional | 22.7 | 23.6 | 21.6 | 24.0 | 18.6 | 14.1 | 19.3 | 23.8 |
| | ethylene glycol bifunctional | | | | | | | | |
| | 1,4-butanediol bifunctional | 5.7 | 5.9 | 5.4 | 6.0 | 4.7 | 3.5 | 4.8 | 6.0 |
| | 1,6-hexanediol bifunctional | | | | | | | | |
| | trimethylolpropane trifunctional | | | | | | | | |
| water repellency-adding material | 3-(2-perfuluorohexyl) ethoxy-1,2 dihydroxypropane MF100 | | | | | | | | |
| | N-α-propyl-N-2,3-dihydroxypropyl sulfoncamido MF110 | 3.6 | 1.3 | 6.3 | 0.2 | 13.4 | 23.5 | 3.2 | 3.8 |
| | $C_8F_{17}O—(CH_2)_4—OH$ PFA6 | | | | | | | | |
| | alcohol-modified silicone SF8427 | | | | | | | | |
| rubber hardness (JISA) | | 72 | 71 | 73 | 72 | 75 | 78 | 72 | 72 |
| the state where water repellency-adding material is present | | compatible | compatible | compatible | compatible | compatible | grain | compatible | compatible |
| water repellency | initial stage | 102° | 95° | 110° | 85° | 120° | 121° | 100° | 102° |
| ink contact angle (backward contact angle) | after ink swelled | 98° | 92° | 106° | 78° | 118° | 118° | 94° | 97° |
| resistance to surface roughening | | • | • | • | • | • | ○ | • | • |
| abrasion resistance | | • | • | • | • | • | • | • | • |
| the situation of pulling out ink | | • | • | • | ○ | • | • | • | • |
| evaluation of recorded image | initial 10,000 shots | • | • | • | • | • | • | • | • |
| | 50,000 shots | • | • | • | ○ | • | ▲ | • | • |
| | 100,000 shots | • | • | • | ▲ | ○ | X | ○ | ○ |
| head damaging resistance | | • | • | • | • | • | • | • | • |
| the situation of ink modification | | • | • | • | • | • | • | • | • |

| | | Experiment | | | | | | | |
|---|---|---|---|---|---|---|---|---|---|
| | | I | J | K | L | M | N | P | O |
| polyurethane prepolymer | PTMEG-MD1 NCO content | 100 NCO 7.7 wt % | 100 NCO 7.7 wt % | 100 NCO 7.7 wt % | 100 NCO 7.7 wt % | 100 NCO 6.4 wt % | 100 NCO 3.2 wt % | | 100 |
| | PPG-MD1 NCO cont. 10.0 wt% | | | | | | | | 100 |
| | PTMEG-HMD1 NCO cont. 7.5 wt % | | | | | | | 100 | |
| | EA-MD1 osteurethane NCO cont. 6.2 wt % | | | | | | | | |
| curing agent | polyethylene glycol molecular weight 100 bifunctional | 22.3 | 22.9 | 23.8 | 24.3 | 69.8 | 34.0 | 22.1 | |
| | ethylene glycol bifunctional | | | | | | | | 2.3 |
| | 1,4-butanediol bifunctional | 5.6 | 5.8 | 5.9 | 6.1 | | | 5.5 | |
| | 1,6-hexanediol bifunctional | | | | | | | 9.3 | 9.3 |
| | trimethylolpropane trifunctional | | | | | | | | |
| water repellency-adding material | 3-(2-perfuluorohexyl) ethoxy-1,2 | 3.6 | | | | | | | |

TABLE 1-continued

| | | | | | | | | | |
|---|---|---|---|---|---|---|---|---|---|
| | dihydroxypropane MF100 | | | | | 3.9 | 3.3 | 3.5 | 2.9 |
| | N-α-propyl-N-2,3-dihydroxypropyl sulfoncamido MF110 | | | | | | | | |
| | $C_9F_{17}O—(CH_2)_4—OH$ PFA6 | | 3.6 | 3.8 | | | | | |
| | alcohol-modified silicone SF8427 | | | | | | | | |
| rubber hardness (JISA) | | 72 | 71 | 69 | 71 | 62 | 51 | 67 | 85 |
| the state where water repellency-adding material is present | | compatible | compatible | grain | — | compatible | compatible | compatible | compatible |
| water repellency | initial stage | 101° | 100° | 94° | 85° | 100° | 98° | 105° | 99° |
| ink contact angle (backward contact angle) | after ink swelled | 96° | 94° | 86° | 69° | 94° | 92° | 100° | 95° |
| resistance to surface roughening | | • | • | ○ | • | • | • | • | • |
| abrasion resistance | | • | • | ○ | • | • | • | • | • |
| the situation of pulling out ink | | • | • | • | ▲ | • | • | • | • |
| evaluation of recorded image | initial 10,000 shots | • | • | • | • | • | • | • | • |
| | 50,000 shots | • | • | ○ | ○ | • | • | • | • |
| | 100,000 shots | • | • | ▲ | ▼ | ○ | ○ | • | • |
| head damaging resistance | | • | • | • | • | • | • | • | • |
| the situation of ink modification | | • | • | ▲ | • | • | • | • | • |

| | | Experiment | | | | | | |
|---|---|---|---|---|---|---|---|---|
| | | Q | R | S | T | U | V | W |
| polyurethane prepolymer | PTMEG-MD1 NCO content | | | | 100 NCO 7.7 wt % | | nitrile hydrogenated rubber | silicone rubber |
| | PPG-MD1 NCO cont. 10.0 wt% | | | | | | | |
| | PTMEG-HMD1 NCO cont. 7.5 wt % | | | | | | | |
| | EA-MD1 osteurethane NCO cont. 6.2 wt % | 100 | 100 | 100 | | 100 | | |
| curing agent | polyethylene glycol molecular weight 100 bifunctional | | | | | | | |
| | ethylene glycol bifunctional | | | | | | | |
| | 1,4-butanediol bifunctional | 1.5 | 1.6 | 4.0 | 5.8 | 4.8 | | |
| | 1,6-hexanediol bifunctional | 5.9 | 6.5 | | | | | |
| | trimethylolpropane trifunctional | | | 1.0 | 1.4 | 1.2 | | |
| water repellency-adding material | 3-(2-perfuluorohexyl) ethoxy-1,2 dihydroxypropane MF100 | 3.2 | | 3.1 | | | | |
| | N-α-propyl-N-2,3-dihydroxypropyl sulfoncamido MF110 | | | | | | | |
| | $C_9F_{17}O—(CH_2)_4—OH$ PFA6 | | | | | | | |
| | alcohol-modified silicone SF8427 | | | | | | | |
| rubber hardness (JISA) | | 89 | 88 | 63 | 70 | 62 | 57 | 60 |
| the state where water repellency-adding material is present | | compatible | — | compatible | — | — | | |
| water repellency | initial stage | 99° | 87° | 101° | 83° | 85° | 99° | 112° |
| ink contact angle (backward contact angle) | after ink swelled | 90° | 76° | 94° | 67° | 72° | 86° | 110° |
| resistance to surface roughening | | • | • | X | X | X | X | ▲ |
| abrasion resistance | | • | • | ○ | ▲ | • | X | X |
| the situation of pulling out ink | | • | ▲ | ▲ | X | X | X | ▲ |
| evaluation of recorded image | initial 10,000 shots | • | • | • | ○ | ○ | ○ | ▲ |
| | 50,000 shots | • | ○ | ○ | X | X | X | X |
| | 100,000 shots | • | ▲ | X | X | X | X | X |
| head damaging resistance | | • | • | • | • | • | ▲ | X |
| the situation of ink modification | | • | • | • | • | • | ▲ | X |

EXAMPLES

In the following, examples of the present invention will be described.

There were used the foregoing cleaning blade sample A which has exhibited excellent cleaning blade characteristics and the foregoing cleaning blade sample S which has not exhibited satisfactory cleaning blade characteristics.

Each of the cleaning blade samples was set to an ink jet apparatus of the constitution shown in FIG. 9 which is capable of conducting full-color recording, wherein the cleaning blade member was subjected to durability test by repeating the cleaning operation 50,000 times.

Description will be made of the full-color ink jet apparatus and the procedures of conducting the cleaning operation.

In FIG. 9, numeral reference 101 indicates a head unit which is fixed to a carriage 102. The carriage 102 is supported by a main scanning rail 103 such that it can be moved in the direction of conducting recording.

In the apparatus, for instance, in the case where clogging takes place at a discharging outlet 101*b* of the head unit 101, a holder 301 provided with caps 300 capable of forming an enclosed space for the head unit in the non-recording zone is moved in the direction expressed by an arrow a to contact the cap 300 with a discharging outlet face 101*a*, and it is stopped at a position where the enclosed space can be forced. Under this state, suction recovery is performed by a pump unit 303 through a tube 302. Ink pulled out from the head unit 101 by way of suction is transported to an ink releasing treatment member 305 through the tube 302. After the suction recovery treatment, the holder 301 provided with the caps 300 is retired in the direction expressed by an arrow b. In this case, ink I pulled out from the discharging outlet 101*b* through the suction recovery remains at the discharging outlet face 101*a*. Herein, by moving the carriage 102, wipping treatment is performed for the discharging outlet face 101*a* by a cleaning blade 401 held on a blade holder 402 (see, FIGS. 9(*b*) and 9(*c*)), whereby the ink I on the discharging outlet face 101*a* can be removed therefrom. An absorbent 104 is fixed to the wipping downstream side of the head unit 101 by means of adhesion or heat caulking. In the structure on the head unit side, a tapered portion 101*c* is formed at a given portion of the discharging outlet face 101*a* which is situated next to the absorbent 104 and on the wipping upstream side to the absorbent 104 such that an edge portion of the absorbent 104 is projected.

A slight amount of ink which possibly remains on the cleaning blade 401 is absorbed by an absorbent 105 as a second absorbing member disposed at the carriage 102, whereby it can be completely removed.

Each of the absorbents 104 and 105 is composed of a polyolefin series porous material which is hardly swelled upon absorbing liquid. Examples of such material are those with a swelling degree of 0.01 to 0.02% prepared by subjecting a sintered body of polyethylene to hydophilizing treatment, specifically, such as SUNFINE AQ (trademark name, produced by Asahi Chemical Industry Co., Ltd.).

Further description will be made with reference to FIGS. 9(*b*) and 9(*c*). The ink I deposited on the discharging outlet face 101*a* by means of the cleaning blade 401 with the movement of the carriage 102. In this case, the ink I is moved together with the cleaning blade 401 along the discharging outlet face 101*a* portion to arrive at the tapered portion 101*c* formed at the given portion of the discharging outlet face 101*a*, wherein the ink I is forced to contact with an edge 104*a* of the absorbent 104, whereby the ink I is taken up from the cleaning blade 401, and the ink (ink I') is once stored in the tapered portion 101*c*. Then, the ink I' is instantly absorbed by the absorbent 104 (the state I' in FIG. 9 (*b*)). Thereafter, when the carriage 102 is further moved, the cleaning blade is moved while being rubbed with the absorbent 105 of the carriage. In this case, the cleaning blade 401 is moved with a slight amount of ink I" remaining on the cleaning blade 401 without being removed by the absorbent 104 being absorbed by the absorbent 105. Because of this, the cleaning blade 501 becomes completely free of the residual ink at its edge portion 401*a* before arriving at the next head unit. By this, there is not occasion for the ink removed from the discharging outlet face 101*a* to influence the adjacent head unit. Therefore, occurrence of color admixture can be effectively prevented, and the edge portion 401*a* of the cleaning blade 401 can be served for successive wipping treatment always in a clean state.

The edge states of each of the cleaning blade samples A and S after the durability test are shown in FIGS. 10(*a*) and 10(*b*) and FIGS. 10(*c*) and 10(*d*), respectively. As apparent from FIGS. 10(*a*) and 10(*b*), it is understood that the cleaning blade sample A prepared by using the bifunctional curing agent only and the water repellency-adding material is completely from occurrence of surface roughening (see, FIG. 4(*a*)), that is can continuously perform excellent cleaning over a long period of time without being worn (see, FIGS. 5(*a*) and 7(*a*)), and that it does not cause deterioration for the quality of an image recorded. On the other hand, as apparent from FIGS. 10(*c*) and 10(*d*), it is understood that the cleaning blade sample S prepared by using the trifuctional curing agent in a relatively great amount is significantly roughened at its surface while being partially worn (see, 4(*b*)), that it not only damages the discharging outlet face upon the cleaning operation but also causes ink escape (see, FIG. 7(*d*)) or/and ink pull-out (see, FIG. 5(*b*)), and that it cannot continuously perform desirable cleaning over a long period of time, wherein deterioration is caused for the quality of an image recorded.

Effects of the Invention

As above described, by using a member prepared by using polyurethane with an addition of an inorganic filler or the like as the principal starting material, and adding a bifunctional curing agent and a water repellency-adding material, there is afforded a cleaning blade which does not damage a discharging outlet face of a recording head and does not have a property of modifying ink; which is hardly worn and is extremely resistant against surface roughening of causing partially broken portions; which excels in water repellency and has a property of reloading ink deposited thereon wherein ink pull-out is not caused; and which continuously exhibits extremely stable cleaning characteristics even upon repeated use over a long period of time.

By using the cleaning blade having such various characteristics, there can be provided a highly reliable ink jet apparatus which enables a conduct high speed recording or full-color recording capable of stably providing high quality recorded images continuously over a long period of time.

BRIEF DESCRIPTION OF THE DRAWINGS

FIG. 1 is a schematic explanatory view illustrating the situation of conducting cleaning by means of a cleaning blade in an ink jet recording apparatus for practicing color recording.

FIG. 2 is a schematic explanatory view illustrating the situation when the edge portion of a cleaning blade enters into a discharging outlet of a recording head to pull out ink.

Figure 3:
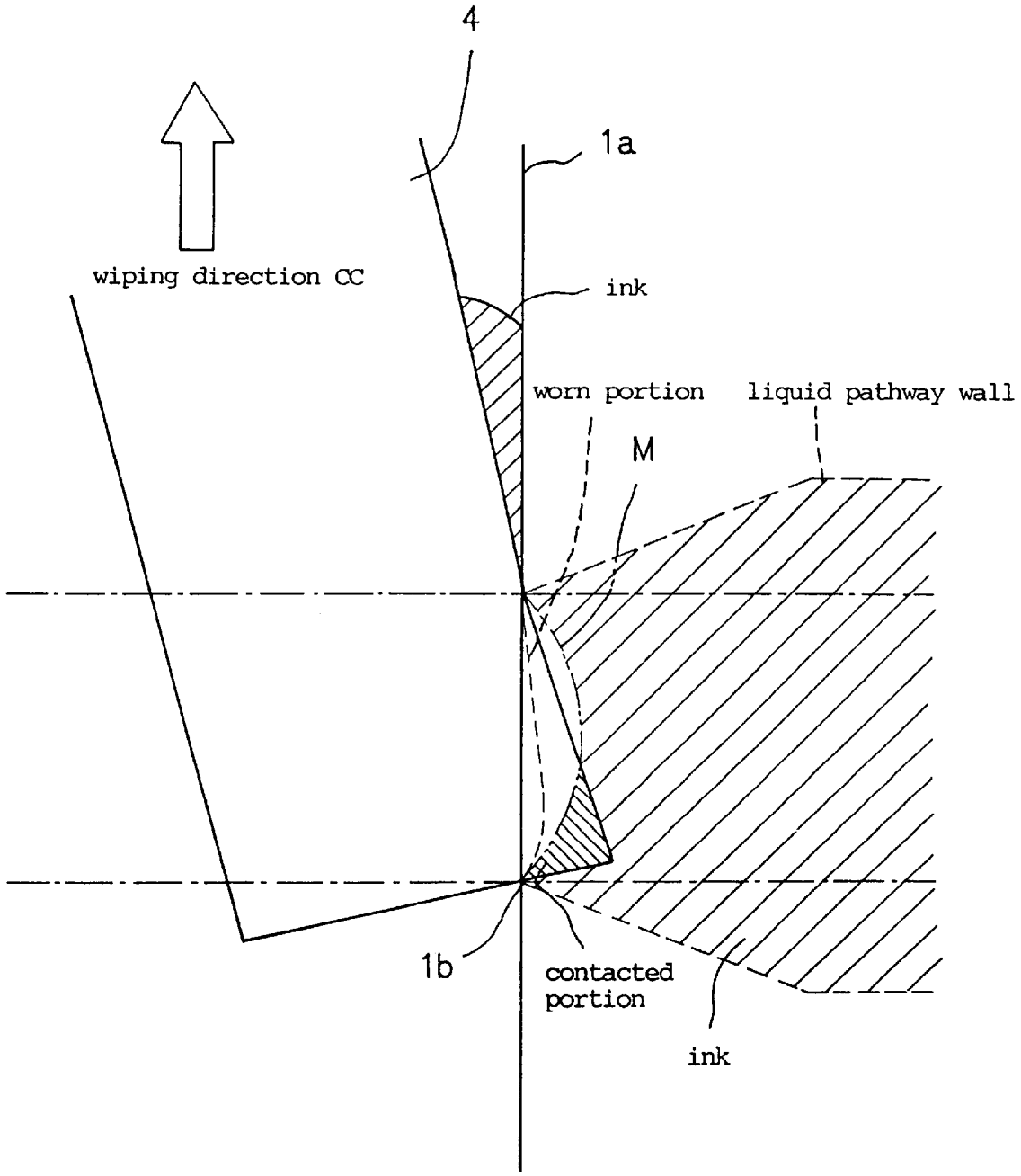
FIG. 3 is a schematic explanatory view illustrating the situation when a cleaning blade with a desirably worn edge portion pulls out ink from a discharging outlet of a recording head.

FIG. 3 is a schematic explanatory view illustrating the situation when a cleaning blade with a desirably worn edge portion pulls out ink from a discharging outlet of a recording head.

FIG. 4 contains views respectively illustrating the state of a cleaning blade after repeatedly used, in which FIG. 4(*a*)

shows a cleaning blade excelling in surface roughening resistance, and FIG. 4(*b*) shows a cleaning blade with a roughened surface which is poor in surface roughening resistance.

FIG. 5(*a*) is a schematic explanatory view illustrating the state when cleaning has been performed in a desirable state; and FIG. 5(*b*) is an explanatory view illustrating the state when ink pull-outs from discharging outlets are occurred during the cleaning operation.

FIG. 6 is a graph illustrating the interrelation between the contact angle of a cleaning blade and the area of ink deposited.

FIG. 7(*a*) and 7(*b*) are schematic views respectively illustrating the state of discharging outlet face having foreign matter of ink or the like deposited thereon; FIG. 7(*c*) is a schematic view illustrating the situation when cleaning has been performed in a desirable state; and FIG. 7(*d*) is a schematic view illustrating the situation when cleaning has been performed by a cleaning blade with a partially worn surface.

FIG. 8 is a schematic slant view illustrating the principal part of an embodiment of an ink jet recording head apparatus provided with a cleaning blade according to the present invention.

FIG. 9(*a*) through 9(*d*) are schematic views stepwise explaining the cleaning operation by a cleaning blade in an ink jet recording apparatus for practicing color recording in the present invention.

FIG. 10(*a*) through 10(*d*) are photographs respectively showing a state of a cleaning blade according to the present invention after having been repeatedly used in the cleaning operation, and states of a cleaning blade not belonging to the present invention after having been repeatedly used in the cleaning operation.

What is claimed is:

1. A cleaning member for removing foreign matter deposited on an ink discharging outlet face of an ink jet recording head for conducting recording on a recording medium by discharging ink, said cleaning member comprising an ether series polyurethane rubber elastic body comprised of:

a polyether polyurethane prepolymer, a curing agent component for said polyether polyurethane prepolymer consisting only of a bifunctional component, and a water repellency-adding material having an active group for chemically bonding to said polyurethane rubber, wherein said curing agent comprises a compound selected from the group consisting of diols, glycols, bisphenols, and diamines, and said water repellency-adding material comprises a compound selected from the group consisting of modified silicone compounds and reactive fluorine-containing compounds.

2. A cleaning member according claim 1, wherein the ink is aqueous ink.

3. A cleaning member according to claim 1, wherein an ink contact angle at a surface of the cleaning member is 80° or above.

4. A cleaning member according to claim 1, wherein an amount of a sum of an active element of the curing agent component and the active group of the water repellency-adding material is present in a molar ratio of 0.8 to 1.05 of an amount of the isocyanate group contained in the polyurethane rubber.

5. A cleaning member according to claim 1, wherein the recording head comprises an ink jet recording system in which recording is conducted by discharging liquid droplets through a discharging element using thermal energy, said ink jet recording system being provided with an electrothermal converting body as a means for generating said thermal energy.

6. A cleaning member according to claim 1, wherein the water repellency-adding material is contained in the polyurethane rubber and the water repellency-adding material is compatible with the polyurethane rubber of the elastic body.

7. A cleaning member according to claim 1, wherein the water repellency-adding material is a fluorine-containing compound.

8. A cleaning member according to claim 1, wherein the water repellency-adding material is present in an amount in a range from 0.1 to 20 parts by weight versus 100 parts by weight of a total amount of the polyurethane rubber and the curing agent component.

9. A cleaning member according to claim 1, wherein said water repellency-adding material is contained in and is compatible with said polyurethane rubber of said elastic body, and said cleaning member has a surface of 80° or above in ink contact angle.

10. A cleaning member according to claim 9, wherein the bifunctional component is a straight-chain diol.

11. A cleaning member according to claim 9, wherein the ink is aqueous ink.

12. A cleaning member according to claim 9, wherein an amount of a sum of an active element of the curing agent component and the active group of the water repellency-adding material is present in a molar ratio of 0.8 to 1.05 of an amount of the isocyanate group contained in the polyurethane rubber.

13. A cleaning member according to claim 9, wherein the water repellency-adding material is a fluorine-containing compound.

14. A cleaning member according to claim 9, wherein the water repellency-adding material is present in an amount in a range of 0.1 to 20 parts by weight versus 100 parts by weight of a total amount of the polyurethane rubber and the curing agent component.

15. An ink jet apparatus provided with a support member for holding an ink jet head for conducting recording on a recording medium by discharging aqueous ink, said support member being provided with a means for scanning between a recording zone wherein said recording medium is transported and a non-recording zone outside said recording zone, and a cleaning blade for cleaning a discharging outlet face of said ink jet head in said non-recording zone, said cleaning blade comprising an ether series polyurethane rubber elastic body comprised of:

a polyether polyurethane prepolymer, a curing agent component for said polyether polyurethane prepolymer consisting only of a bifunctional component, and a water repellency-adding material having an active group for chemically bonding to said polyurethane rubber, wherein said curing agent comprises a compound selected from the group consisting of diols, glycols, bisphenols, and diamines, and said water repellency-adding material comprises a compound selected from the group consisting of modified silicone compounds and reactive fluorine-containing compounds.

16. An ink jet apparatus according to claim 15, wherein said water repellency-adding material is contained in and is compatible with said polyurethane rubber of said elastic body, and said cleaning blade has a surface of 80° or above in ink contact angle.

* * * * *

UNITED STATES PATENT AND TRADEMARK OFFICE

CERTIFICATE OF CORRECTION

PATENT NO. : 6,176,565 B1
DATED : January 23, 2001
INVENTOR(S) : Noriyuki Yanai et al.

It is certified that error appears in the above-identified patent and that said Letters Patent is hereby corrected as shown below:

Title page,
Item [30], Foreign Application Priority Data, insert:
-- Sep. 11, 1991 (JP) Japan 3-231911
Sep. 11, 1991 (JP) Japan 3-231912 --.

Column 1,
Line 11, “matters” should read -- matter --.

Column 3,
Line 16, “viewpoints” should read -- viewpoints are --.

Column 6,
Line 32, “were” should read -- was --; and
Line 40, “ate” should read -- are --.

Column 10,
Line 24, “illustrated” should be deleted.

Column 11,
Line 65, “in” should read -- from --.

Column 13,
Line 19, “maintain” should read -- maintains --; and
Line 48, “element” should read -- elements --.

Column 15,
Line 67, “34.0 parts.” should read -- 34.0 parts --.

Column 17,
Line 46, “qutlets” should read -- outles --; and
Line 55, “recovery” should read -- recover --.

Column 20,
Line 19, “The, the” should read -- The --;
Line 21, “patter” should read -- pattern --;
Line 23, “times, these” should read -- times, In these --;
Line 36, “a-recorded” should read -- a recorded --; and
Line 59, “provide” should read -- provides --.

UNITED STATES PATENT AND TRADEMARK OFFICE

CERTIFICATE OF CORRECTION

PATENT NO. : 6,176,565 B1
DATED : January 23, 2001
INVENTOR(S) : Noriyuki Yanai et al.

It is certified that error appears in the above-identified patent and that said Letters Patent is hereby corrected as shown below:

Column 21,

Table 1,

| | | |
|---|---|---|
| "78 | | --78 |
| grain | | grain |
| 121° | should read | 121° |
| 118° | | 118° |
| ○ | | ○ |
| •" | | Δ--. |

Column 23,

Table 1,

| | | |
|---|---|---|
| "89 | | --89 |
| compa- | | compa- |
| tible | should read | tible |
| 99° | | 98° |
| 90°" | | 90°--. |

Column 25,
Lines 35, 39 and 44, "wipping" should read -- wiping --;
Line 57, "deposited" should read -- is deposited --.

Column 26,
Line 13, "wipping" should read -- wiping --;
Line 20, "completely" should read -- completely free --;
Line 21, "is can" should read -- it can --;
Line 67, "after" should read -- after being --; and Column 26, line 54 - Column 27, line 34,
Text should appear at Column 9, line 7.

Column 28,
Line 66, "according" should read -- according to --.

Signed and Sealed this

Twenty-eighth Day of June, 2005

JON W. DUDAS
*Director of the United States Patent and Trademark Office*